United States Patent [19]

Colson

[11] 3,945,549

[45] Mar. 23, 1976

[54] AUTOMATIC STITCH NAILING APPARATUS

[75] Inventor: Donald W. Colson, Minneapolis, Minn.

[73] Assignee: Viking Pallet Corporation, Osseo, Minn.

[22] Filed: Sept. 20, 1974

[21] Appl. No.: 507,960

[52] U.S. Cl. ..... 227/45; 227/101

[51] Int. Cl.² ..... B27F 7/02

[58] Field of Search ..... 227/2, 3, 4, 5, 6, 7, 44, 227/45, 48, 99, 100, 101

[56] References Cited

UNITED STATES PATENTS

| | | | |
|---|---|---|---|
| 2,111,081 | 3/1938 | Taylor | 227/45 |
| 3,207,403 | 9/1965 | Stoddard et al. | 227/101 |
| 3,606,130 | 9/1971 | De Lamar et al. | 227/45 |

*Primary Examiner*—Granville Y. Custer, Jr.
*Attorney, Agent, or Firm*—Merchant, Gould, Smith, Edell, Welter & Schmidt

[57] ABSTRACT

A stitch nailing apparatus for automatically sequentially placing transversely extending slats in predetermined spaced relationship with one another onto a plurality of longitudinally advancing stringers and for repetitively nailing each slat to the stringer in stitch nailing fashion, immediately following its placement thereon. A first conveyor, mounted on an elongated frame, advances and guides a lowermost stringer longitudinally of the elongated frame from each of a plurality of spaced stringer magazines. The plurality of advancing stringers simultaneously proceed in spaced parallel relationship to a nailing station wherein a separate nailing head is adjacent each stringer. A slat magazine, disposed between the nailing heads and the stringer magazines, holds a vertical stack of slats. A slat conveyor advances the lowermost slat from the slat magazine to a position transversely overlying the stringers at the nailing station. Electromechanical control means are provided for sequentially actuating the first and the slat conveyors and the nailing heads to drive nails through the positioned slat and into each stringer, and for thereafter coordinating alternate movement of the first conveyor with actuation of the nailing heads to drive additional nails in stitch fashion through the slat and into each of the stringers. The electromechanical control means automatically senses the completed nailing of a slat to the stringers, and repeats the cycle sequentially by advancing the stringers a predetermined longitudinal distance by positioning another slat overlying the stringers and by stitch nailing the slat to the stringers. The cycle is continuously repeated or interrupted in response to the control means. The apparatus readily adjusts to accomodate stringers and slats of varied dimensions and to assemble such stringer and slat assemblies of varied shapes and configurations.

25 Claims, 21 Drawing Figures

3
3

FIG. 5
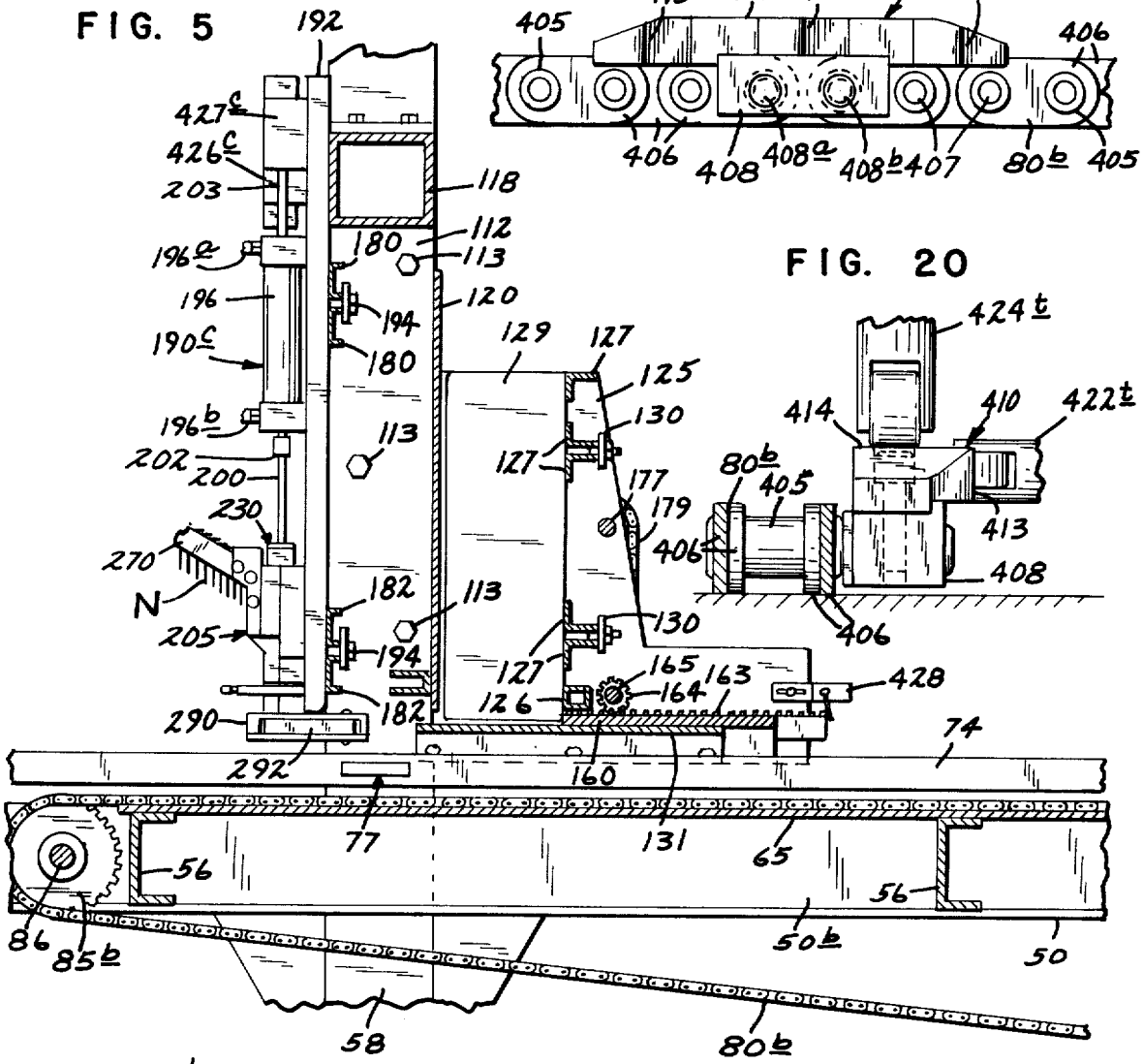
FIG. 19
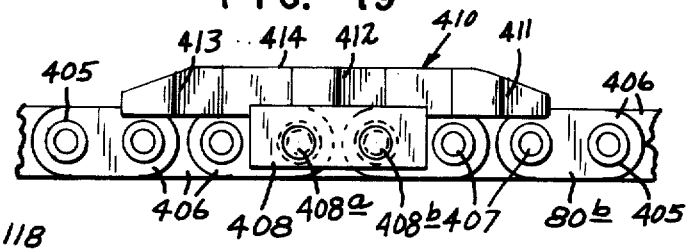
FIG. 20
FIG. 18
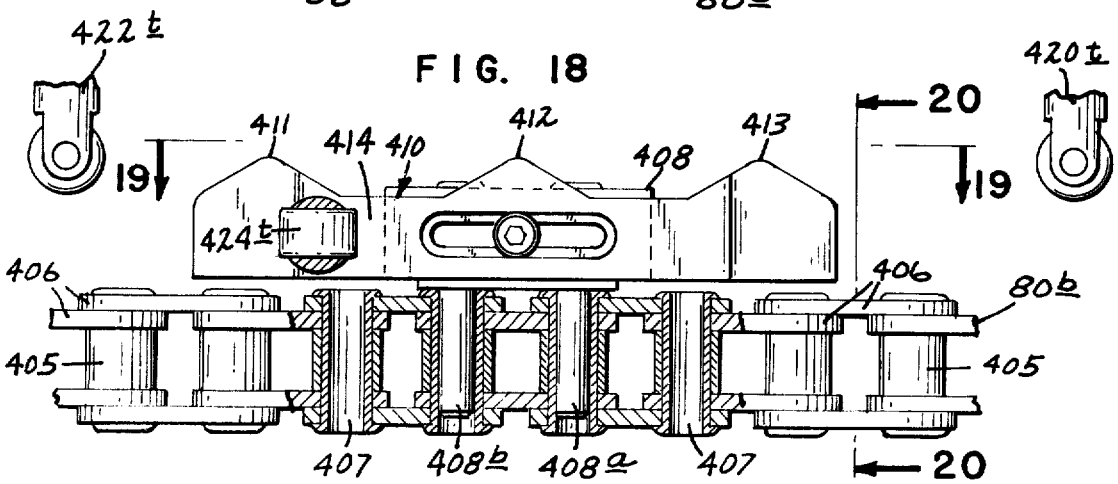

A
B
C
ST
SL

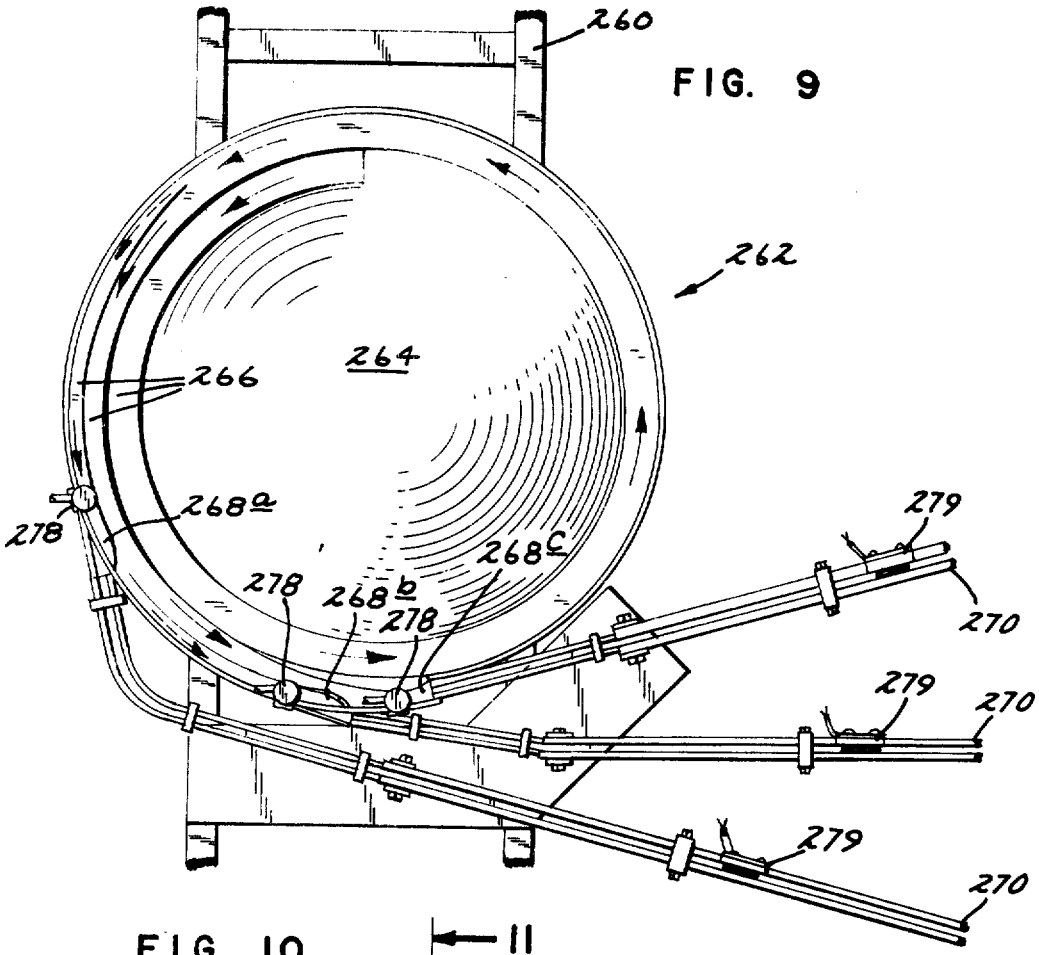
FIG. 9
FIG. 10
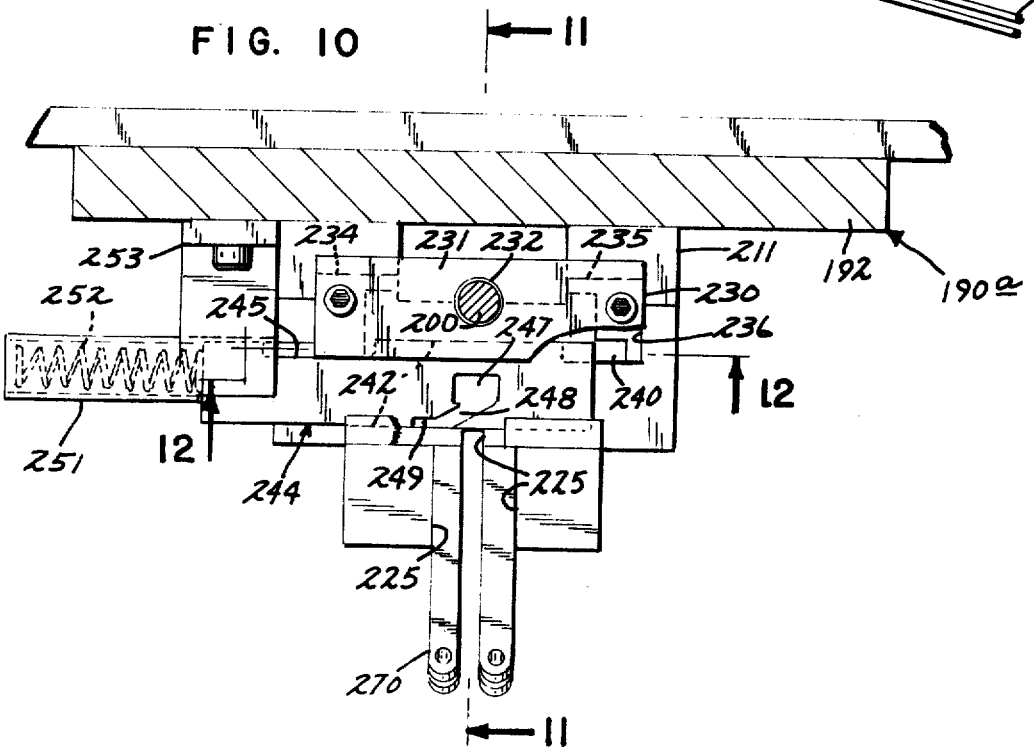

AUTOMATIC STITCH NAILING APPARATUS

BACKGROUND OF THE INVENTION

Field of the Invention: The present invention relates generally to automatic nailing devices and more particularly to an automatic stitch nailing device for repetitively positioning and nailing transverse slats onto parallel longitudinally advancing stringers.

Description of the Prior Art: The economics required in manufacturing practices today, demand that automatic devices replace manual labor in certain repetitive manufacturing operations. This demand is particularly noticeable in the construction of such articles as docks, pallets, certain types of fences, etcetera, having assembly steps involving the common operation of repeatedly securing or nailing a plurality of parallel slats to at least one side of a plurality of parallel, spaced apart stringers. Another such example is in the construction of certain types of wood frames which contain transverse members secured to longitudinal stringers and assembled in a given pattern to form a frame.

Known prior art devices for performing such tasks have attacked the problem by first collecting and positioning the individual parts of the article of manufacture and thereafter conveying the pre-positioned parts to a plurality of nailing heads for the final securing operation. This, of course, requires complicated jigs and clamping devices for holding the individual parts in their correct positions relative one another during both the conveying and the nailing operations. This preassembly concept also requires the use of manual labor to assemble the parts in their aligned positions, or alternatively, complicated mechanical or electromechanical mechanisms must be provided to accomplish the preassembly operations.

Another approach toward solving the automation problem, which applies particularly to the construction of pallets has been to provide a machine which advances a plurality of stringers extending on a conveyor transversely of the direction of their advancement, into underlying engaging relationship with a plurality of deck boards stacked in a hopper in predetermined relationship to one another and extending longitudinally of the conveyor. Thereafter, the stringers and the bottom layer of deck boards are unitarily advanced beneath a nailing mechanism with the remaining vertically stacked deck boards in the hopper serving to hold the advancing stringers and engaged deck boards in position during the nailing process. This arrangement not only requires the use of a large number of nailing heads, since at least one nailing head and more often a plurality of nailing heads must be provided to nail each deck board, but also requires heavy duty components for producing articles having long stringers with a large number of deck boards, as for example long sections of dock or fence structures. The heavy duty construction is required as a consequence of the large mechanical forces exerted by the weight of the increased number of deck boards stacked in the hopper for holding down the lowermost deck board being nailed to the stringers. These requirements not only result in an expensive machine but also one in which the possibility of malfunction is increased because of the greater number of nailing heads which must be operated.

An additional problem in many automatic and semiautomatic assembly and nailing machines is their failure to permit ready adjustment to the parts and control devices of the machine for accommodating stringers and slats of varying sizes and shapes and for readily adjusting the positioning of the stringers and slats relative one another to enable the manufacture of assembled structures of varying sizes and configurations.

The present invention overcomes these problems and shortcomings of the prior art by providing a simple, reliable and relatively inexpensive apparatus for automatically assembling transverse slats to longitudinally advancing stringers by using a minimum number of nailing heads operative in repetitive stitch nailing fashion, and which is rapidly adjustable for accommodating slats and stringers of varied dimensions and for manufacturing articles of various sizes and configurations. While the present invention will be described with reference to a specific embodiment thereof employing a given number of stringers and nailing heads it will be understood that the invention is not limited to this specific embodiment but includes any number of such stringers and nailing heads. Further, while the present invention as described employs a particular electromechanical control system, it will be understood that other control systems which perform equivalent functions necessary to the operation of the apparatus may be used without departing from the spirit or intent of this invention.

SUMMARY OF THE INVENTION

The automatic nailing apparatus of the present invention includes an elongated frame having a transversely extending frame member overlying the frame. A plurality of stringer magazines are mounted on the frame for vertically stacking a plurality of stringers to extend longitudinally of the elongated frame at spaced apart parallel positions. A first conveyor is mounted on the elongated frame for guiding and for advancing a lowermost one of the vertically stacked stringers from each of the stringer magazines in a direction longitudinal of the elongated frame and toward the transversely extending frame member. A plurality of nailing heads are positionally mounted on the transverse frame member, each in longitudinal alignment with one of the stringers, for defining a plurality of nailing stations. A slat magazine is mounted on the transversely extending frame member to vertically stack a plurality of slats extending transversely of the stringers and between the transverse frame member and the stringer magazines. A slat conveyor cooperates with the slat magazine for advancing a lowermost slat therefrom and for positioning the slat on the advancing stringers at the nailing stations. Control means activate the first conveyor for advancing the stringers to their respective nailing stations, actuate the slat conveyor for advancing and positioning a slat on the stringers at the nailing stations and actuate the plurality of nailing heads for driving at least one nail through the slat into each stringer positioned at the plurality of nailing stations. The control means is electromechanically activated and includes cam activated limit switches and cooperating control circuits. The cam device and limit switches can be adjustably cooperatively positioned for controlling the number of nails driven into each slat and for controlling the relative spacing between successive slats on the stringers, independent of the width of the slats.

It is one object of the present invention, therefore, to provide a stitch nailing machine which will automatically feed stringers toward nailing stations where transversely extending slats will be rapidly and accurately positioned and nailed thereto regardless of the dimensions of the slats or of the length of the stringers.

It is another object of the present invention to provide a device of the above-described character which may be readily adjusted to accept stringers and slats of varying lengths, widths and thicknesses.

It is a further object of the present invention to provide a device of the above-described character which requires a minimum of skill and effort on the part of an operator and which rapidly, accurately and reliably performs its intended functions over extended periods of operation.

These and other objects of the invention will become apparent to those skilled in the art upon consideration of the accompanying specification, claims and drawing.

BRIEF DESCRIPTION OF THE DRAWING

Referring to the drawing, wherein like numerals represent like parts throughout the several views:

FIG. 5, Sheet 4, is an enlarged vertical sectional view of the device shown in FIG. 1, as generally seen from the section line 5—5 of FIG. 4, illustrating a nailing head unit in side elevation, a portion of a stringer advancing conveyor and a portion of the slat magazine and slat advancing mechanism of the present invention;

FIG. 9, Sheet 6, is a fragmentary plan view of the device of FIG. 1, as generally viewed along the line 9—9 of FIG. 1, illustrating the mechanism for orienting and for controlling the flow of nails to nailing heads of the present invention;

FIG. 10, Sheet 6, is an enlarged horizontal sectional view of one of a plurality of nailing heads of the present invention, as generally taken along the section line 10—10 of FIG. 4;

FIG. 18, Sheet 4, is an enlarged plan view of a cam member mounted to the stringer conveyor and contained within the circle "C" of FIG. 6, portions thereof being broken away to better illustrate the cam member sequential activation of the spaced limit switches cooperating therewith;

FIG. 19, Sheet 4, is a view in front elevation of the cam member of FIG. 18, as generally seen along the line 19—19 of FIG. 18;

FIG. 20, Sheet 4, is a view in vertical section of the stringer conveyor and attached cam member of FIG. 18, as generally taken along the section line 20—20 of FIG. 18.

DESCRIPTION OF THE PREFERRED EMBODIMENT

Figure 1:
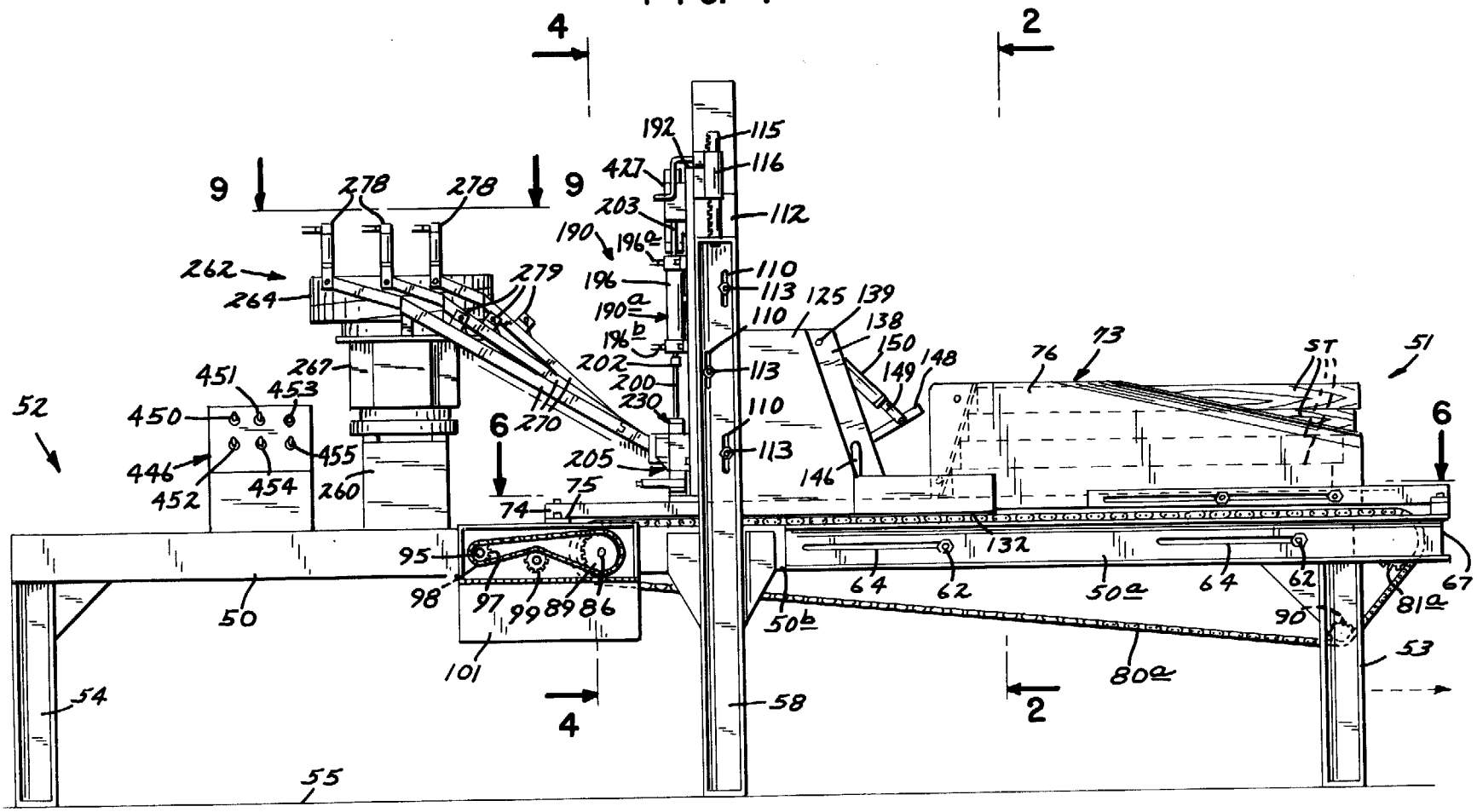
FIG. 1 is a view in side elevation of a preferred embodiment of a stitch nailing device constructed in accordance with the present invention.
Figures 2, 3:
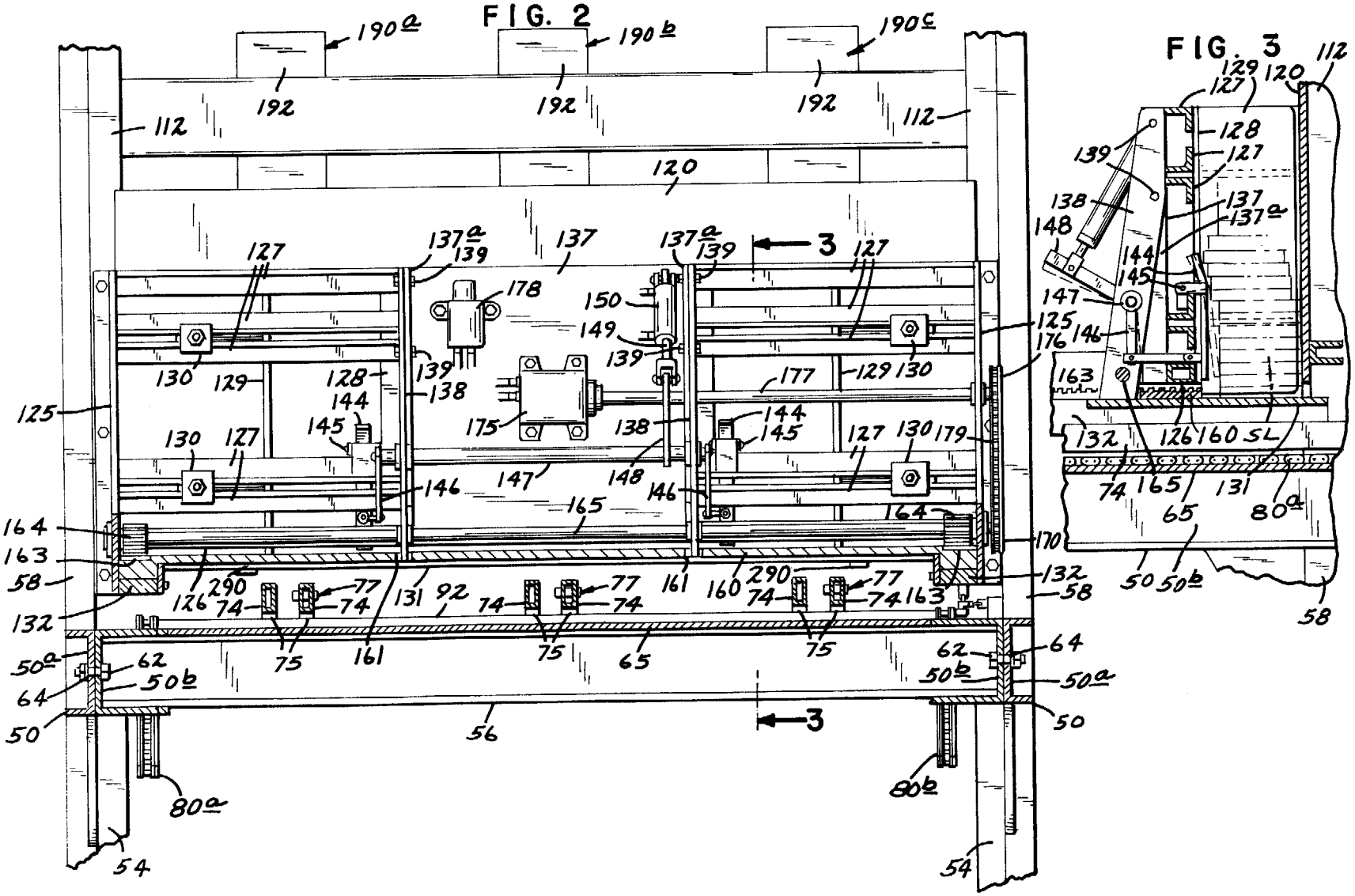
FIG. 2, Sheet 2 is an enlarged vertical sectional view of the device of FIG. 1, as generally seen from the section line 2—2 of FIG. 1.
FIG. 3, Sheet 2, is a detail sectional view of the device of FIG. 2, as taken along the section line 3—3 of FIG. 2, illustrating a portion of the slat magazine and the slat advancing mechanism of the present invention.
Figures 6, 7, 8:
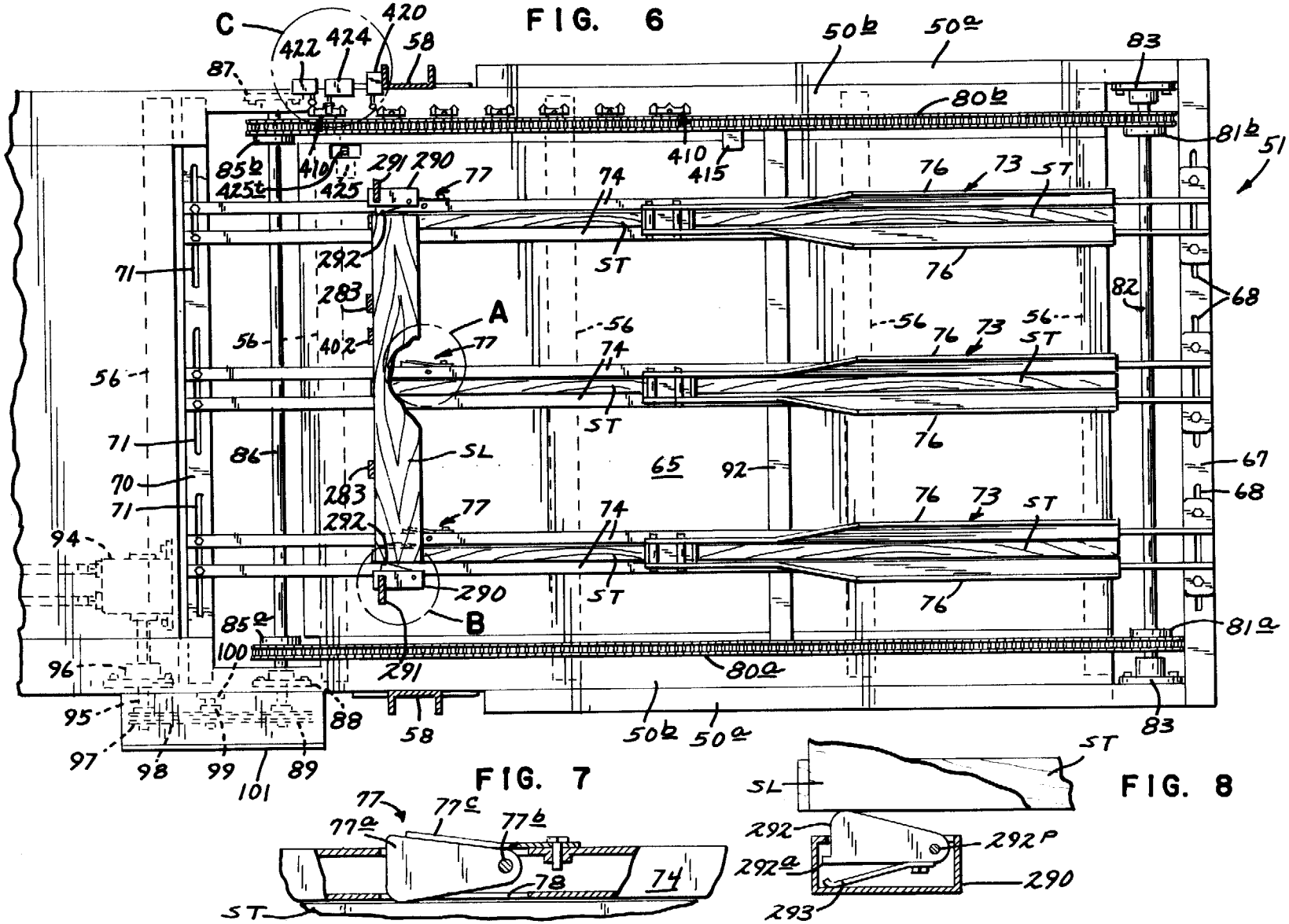
FIG. 6, Sheet 5, is an enlarged horizontal sectional view of the device shown in FIG. 1, as generally taken along the section line 6—6 of FIG. 1.
FIG. 7, Sheet 5, is an enlarged detailed view of that mechanism illustrated within the circle "A" of FIG. 6, portions thereof being broken away and shown in section for illustrating the means for accurately positioning a stringer member within a respective guide track of the present invention.
FIG. 8, Sheet 5, is a plan view of that mechanism illustrated within the circle "B" of FIG. 6, portions thereof being broken away and shown in section to better illustrate one of a pair of devices for positioning a slat to be nailed by the device shown in FIG. 1.

Referring to the Figures, there is generally shown a preferred embodiment of a stitch nailing system constructed in accordance with the teachings of the present invention. Referring to FIGS. 1, 2 and 6, a pair of parallel spaced apart elongate frame rail members 50 longitudinally extend between a receiving end generally designated at 51 of the system, and a delivery end generally designated at 52. A pair of upright support legs 53 support the frame rail members 50 at the receiving end 51, and a pair of upright support legs 54 support the frame rail members 50 at their delivery end 52 in generally parallel relationship upon and above a floor 55. A plurality of cross member support beams, generally designated at 56, connect the pair of rail members 50 at spaced intervals longitudinally therealong, maintaining the spaced parallel relationship of the rails 50 with one another. A pair of vertically oriented outwardly directed frame members 58 are connected to support the elongate frame rail members 50 at a position therealong intermediate their receiving and delivery ends 51 and 52 respectively, and in the preferred embodiment are approximately near the longitudinal central portion of the frame rail members 50.

In the preferred embodiment, that portion of each of the frame rail members 50 disposed between the receiving end 51 and the vertical frame members 58 comprise a pair of cooperatively engaging beam members (the outwardly directed beam member being designated as 50*a* and the inwardly directed beam member being designated as 50*b*), for adjustably operatively extending the effective length of the frame rail members 50. The beam rail members 50*a* and 50*b* are adjustably slidably connected to one another by means of a plurality of bolts 62 which are rigidly anchored to the inner rail beam member 50*b* and project outwardly therefrom through a pair of longitudinally extending adjustment slots 64 in the outer rail beam member 50*a*, allowing the outer rail beam member 50*a* to be moved longitudinally with respect to the inner wall rail beam member 50*b* within the adjustment range provided by the slots 64. In the preferred embodiment, the outer and inner rail beam members 50*a* and 50*b* respectively are securely clamped to one another in the desired extended position by hex-head nuts threaded to the projecting ends of the bolts 62. This adjustment feature provides for rapidly extending or shortening the effective length of the frame rail members 50 between the receiving end 51 and the vertical frame members 58 to accomodate stringers of varied lengths, as hereinafter described.

In the preferred embodiment, a plate of sheet material 65 is supported by and connected to the cross member support beams 56 (FIG. 2) and extends laterally between the elongate frame rail members 50 such that the top surface of the plate 65 and the top surfaces of the rail members 50 define a generally planar surface bed upon which a plurality of stringers slidably advance, as hereinafter described. The plate 65 extends longitudinally from the receiving end 51 and toward the delivery end 52, terminating at a position intermediate the frame members 58 and the delivery end 52 (FIG. 6).

A first stringer magazine support member 67 extends transversely between and is secured near its end to the top surfaces of the pair of rail beam members 50 at the receiving end 51 (FIGS. 1 and 6). The support member 67 is of predetermined thickness and has a plurality of elongate longitudinally extending adjustment slots 68 formed therein. A second stringer magazine support member 70, extends transversely between and is secured at its ends to the pair of elongate frame beam members 50 at a longitudinal position along the frame rail members 50 that is between the non-receiving disposed end of the plate 65 and the delivery end 52 of the system. The top surface of the support member 70 is generally planar with the top surface of th plate 65. The support member 70 has a plurality of elongate adjustments slots 71 formed therein, generally longitudinally disposed therealong to align with the adjustment slots 68 in the first support member 67.

In the preferred embodiment, three stringer magazine units generally designated at 73, longitudinally extend between and are bolted to the first and second stringer support members 67 and 70 respectively, in parallel spaced apart relationship to one another (FIGS. 1, 2 and 6). The plurality of elongate adjustment slots 68 and 71 in the stringer magazine support members 67 and 70 respectively allow for precise and rapid lateral adjustment and alignment of the stringer magazine units 73 between the pair of frame rail members 50. Although three stringer magazine units 73 are illustrated in the preferred embodiment, it will be understood that the support members 67 and 70 could be adapted to accomodate any desired number of such magazine units within the spirit and intent of this invention.

In the preferred embodiment, each stringer magazine unit 73 comprises a pair of base support guides 74 longitudinally extending between and adjustably connected to the first and second lateral support cross members 67 and 70. At the receiving end 51 of the system, the bottom surfaces of the plurality of base support guides 74 directly engage the top surface of the first stringer magazine support member 67. At the delivery end 52 of the system, a plurality of spacer members 75, of predetermined thickness, are connected between the plurality of base support guides 74 and the second stringer magazine support 70 (FIGS. 1 and 2) so as to elevate the bottom surfaces of the base support guides a predetermined height from the top surface of the plate 65 and in generally parallel relationship therewith. The plurality of base support guides 74 are bolted at their ends to the first and second magazine support members 67 and 70 respectively through the adjustment slots 68 and 71 respectively therein. Each base support guide 74 is longitudinally extendable near the receiving end 51 of the system, in similar fashion to that previously described with respect to the extension capabilities of the elongate frame rail members 50, for enabling rapid adjustment of the effective length of the base support guide members 74, whenever the effective lengths of the pair of elongate frame rail members 50 are adjusted.

Each stringer magazine unit 73 further has a pair of downwardly converging side plates 76 (FIGS. 1 and 6) secured respectively at their lower ends to the pair of base support guides 74, and longitudinally extending between the receiving end 51 of the system to a position intermediate the receiving end 51 and the vertically oriented frame members 58. The converging side plates 76 and the base support guide members 74 in combination form a hopper-like structure for holding a plurality of vertically stacked stringer boards. The stringer boards are designated throughout the Figures by "ST". The plate bed 65, therefore, defines the lower surface of the plurality of stringer magazine units 73 such that the lowermost stringer (ST) held within one of the stringer magazine units 73 will directly contact the plate 65. In practice, the pair of base support guides 74 of each stringer magazine unit 73 are oriented parallel to one another and are laterally spaced apart a distance somewhat larger than the width of a stringer (ST) being held thereby to enable generally unrestricted longitudinal movement of the stringer between each pair of base support guides 74, along the entire lengths thereof.

Referring to FIG. 6, each of the rightmost ones, as viewed from the receiving end 51, of the pairs of base support guides 74 of the stringer magazine units 73 has a stringer positioning element, generally designated at 77. The plurality of stringer positioning elements are generally laterally aligned with one another at a longitudinal position along the system near the vertically oriented frame members 58. A detail enlarged view of one of the stringer positioning elements 77 is illustrated in FIG. 7. Referring to FIG. 7, the stringer positioning element 77 generally comprises a cam member 77*a* connected for pivotal rotation about a vertically oriented pivot axis 77*b*, and freely movable thereabout through a slot 78 formed in the inwardly directed surface of the base support guide 74 in which it is mounted, so as to project within the stringer race defined between each pair of base support guides 74. A spring element 77*c* normally urges the cam 77*a* in counterclockwise rotation (as viewed in FIG. 7) about its pivot axis 77*b* such that the cam 77*a* extends within the stringer race, for urging an advancing stringer board (ST) therein toward engagement with the opposing base support guide 74 which defines that particular stringer race. The cam element 77*a* is shown in FIG. 7 as it would appear when forced by a stringer board (ST) to rotate in the clockwise direction about its pivot axis 77*b* against the bias of the spring element 77*c*, to the "retracted" position illustrated.

A pair of matching endless conveyor chains 80*a* and 80*b* are longitudinally disposed between and in relatively close proximity with the pair of elongate frame rail members 50, such that the "upper" longitudinally extending portions of the conveyor chains extend above the plate bed 65 (see FIGS. 1, 2 and 6). The conveyor chains 80*a* and 80*b* engage a pair of idler sprockets 81*a* and 81*b* respectively, connected for common rotation by means of an axle 82 adjacent the receiving end 51 of the assembly (FIG. 6). The ends of the axle 82 are journaled in bearings 83 connected to the pair of elongate frame rail members 50. The conveyor chains 80*a* and 80*b* are repectively driven by a pair of drive spockets 85*a* and 85*b* commonly connected by means of an axle 86. That end of the axle 86 which is connected to the drive sprocket 85*b* rides in a bearing 87 mounted to one of the pair of elongate frame members 50. The opposite end of the axle 86 is journaled for rotation through a bearing 88 in the opposing elongate frame rail member 50 and terminates at an axially connected primary drive sprocket 89. The lower (return) portions of the pair of conveyor chains 80*a* and 80*b* pass beneath the general plane of the plate member 65 and engage a pair of idler sprockets 90 (FIG. 1), rotatably connected to the inside surfaces of the pair of upright support legs 53 at the receiving end 51 of the apparatus. In the preferred embodiment, the conveyor chains 80*a* and 80*b* comprise a plurality of interconnected links which may be added to or subtracted from one another for respectively increasing or decreasing the lengths of the chains to correspond to adjustments made in the effective lengths of the pair of elongate frame rail members 50, as previously described.

A plurality of drive bars 92 (FIGS. 2 and 6) laterally extend between the pair of conveyor chains 80*a* and 80*b* at predetermined spaced intervals therealong and are connected for movement therewith along the top surface of the plate 65. The drive bars 92 are connected to the conveyor chains 80*a* and 80*b* so as to lie generally perpendicular to the longitudinally extending stringer magazine units 73. The drive bars 92 are of a thickness to enable them to proceed unimpeded below the bottom surface of the plurality of base support guides 74 of the stringer magazine units 73 and operatively engage, at the receiving end 51, the ends of the lowermost stringers (ST) in each stringer magazine unit 73 and longitudinally simultaneously advance (from right to left in FIG. 6) those engaged stringers along the bed formed by the top surface of the plate 65. It will be noted that the thickness of the first stringer magazine support member 67 and of the spacer elements 75 is somewhat greater than that of the drive bars 92, thus providing sufficient elevation of the base support guides 74 above the plate 65 to enable free longitudinal movement of the drive bars 92 thereunder.

A first reversing motor 94 (FIG. 6) is mounted to one of the cross member support beams 56 of the system near the second stringer support member 70. The motor 94 has a shaft 95 journaled for rotation through a bearing 96 in one of the elongate frame rail members 50, and terminating at a drive sprocket 97 (FIG. 1). A primary endless drive chain 98 engagably connects the primary conveyor drive sprocket 89 for rotation with the drive sprocket 97. The drive chain 98 passes over an idler sprocket 99, also journaled in a bearing 100 (FIG. 6) connected to the elongate frame rail member 50. In the preferred embodiment, the assembly comprising the drive sprockets 97 and 89, the chain 98, and the idler sprocket 99 is enclosed for safety purposes, by a hinged door 101 (FIG. 1).

In the preferred embodiment, the pair of vertically oriented support members 58 are U-shaped channel beams having a plurality of staggered slots 110 longitudinally extending in staggered relationship near the upper portion of the beams 58 (FIG. 1). Referring to FIGS. 1, 2, 4 and 5, a pair of U-shaped channel beams 112 cooperatively mate with the upright support members 58 at a position vertically above the general plane of the plate 65 such that the "bottom" portions of the "U" channels of the beams 58 and 112 engage one another. The beams 112 carry the nailing and slat supply apparatus of the system, as hereinafter described. Each of the upright beam members 112 has a plurality of bolts 113 anchored therein and projecting outwardly through the "bottom" surface of the "U" channel (see FIGS. 5 and 1), so as to extend through the elongated staggered slots 110 in the outer upright frame members 58. The ends of the bolts 113 extending through the slots 110 are threaded to receive nuts for securely clamping the respective beam members 112 to the outer stationary beam members 58. This bolt and slot arrangement enables vertical adjustment of the inner upright beams 112 relative to the outer stationary upright beam members 58.

The upright frame members 58 have vertically oriented gear rack portions 115 (FIGS. 1 and 4) forming vertical extensions of their upper ends. Each of the beam members 112 has a pinion gear and associated crank assembly 116 secured to its outwardly directed surface and sized to matingly engage the rack gear extensions 115 of the support members 58. This rack and pinion gear assembly provides ready adjustment capability for vertically positioning the inner beams 112 relative the outer beams 58 as permitted by the bolt and slot configurations (113 and 110 respectively). A vertical height adjustment of the inner beams 112 relative the outer beams 58 is effects by loosening the nuts on the bolts 113, and by thereafter turning the cranks on the pinion gear assemblies 116 in the desired direction to raise or lower the beams 112. The nuts on the bolts 113 are then resecured after the desired vertical position has been obtained.

The pair of inner upright support beams 112 are rigidly attached to one another by means of a first transversely extending cross beam 118 (see FIGS. 2, 4 and 5) and by means of a second upper transversely extending mounting beam 119. The pair of upright support beams 112 are further connected to one another by means of a plate 120 transversely extending between and securely attached to those inwardly directed walls of the U-shaped beams 112 which are oriented toward the receiving end 51 of the system. The structure, therefore, defined by the upright support beams 112 and its interconnecting beams and plate, is one unified assembly which is vertically movable between the upright beams 58 as previously described and to which other apparatus is attachable, as hereinafter described.

A pair of support plate members 125 (FIGS. 1, 2 and 5) are secured to each of the inner upright support members 112 and extend longitudinally with the rail beam members 50 toward the receiving end 51 of the system. The support plates 125 generally mount the transverse slat supplying and handling apparatus of the present invention. A plurality of angle iron support members 127 transversely extend between and are secured at their ends to the outer support plates 125 at a distance longitudinally spaced from the plate 120 in the direction toward the receiving end 51 of the system (FIGS. 1 and 5). The angle iron support members 127 are disposed in generally parallel fashion with and above the plate 65. Two pairs of the support members 127 are relatively positioned with respect to one another such that adjacent members of each pair are separated by a predetermined vertical distance to slidingly allow passage of the shank of an adjustment bolt therebetween. A vertically oriented plate 128 is secured to the planarly aligned surfaces of the plurality of support members 127 near the center of the system, and in combination with the plate 120 define front and rear walls of a hopper for holding a vertical stack of slat boards (SL) therebetween. A stiffener support brace 126 transversely extends between and is secured at its ends to the pair of support plates 125, and is connected to the plate 128 adjacent its bottom edge to give stiffening support thereto.

A pair of vertically oriented slat end guide plates 129 (FIGS. 2 and 5) are adjustably mounted to the plurality of support members 127 and define end walls of the "slat hopper". The end plates 129 have a plurality of adjustment brackets 130 mounted thereto, and aligned for slidable movement within the adjustment slots or races defined by the cooperating pairs of angle iron supports 127. The brackets 130 enable rapid lateral adjustment of the end plates 129 for positioning slat boards stacked therebetween in the desired position relative to the longitudinally advancing stringers.

Referring to FIGS. 2, 3 and 5, the floor of the slat hopper is defined by a bottom plate 131 laterally extending between and secured to the outer support plates 125, overlying and generally parallel with the plate 65 and at a spaced distance thereabove as determined by the adjustable "height" position of the entire central portion of the system. Those ends of the plate 131 adjacent the support plates 125 are recessed (FIG. 2) to form a pair of guides or races 132 (the purpose of which will be hereinafter described) with the outer support plates 125, which run longitudinally with the bottom plates 125 along their inwardly directed surfaces. Referring to FIG. 3, it will be noted that the bottom plate 131 longitudinally extends slightly beyond the plate 120 toward the delivery end 52 of the system, and extends considerably past the plate 128 toward the receiving end 51 of the system.

A mounting plate 137 generally centrally positioned along the length of the plurality of angle iron support members 127 and of the stiffener support brace 126 and is welded thereto in generally vertical fashion (FIGS. 2 and 3). The vertical height of the mounting plate 137 is generally defined by the topmost angle iron 127 and the bottom surface of the stiffener brace member 126. The outwardly oriented ends of the mounting plate 137 are flanged (137*a*) to project toward the receiving end 51 of the system. A pair of braces 138 are bolted at 139 to the flanges 137*a* of the plate 137 and extend obliquely downward therefrom to the base plate 131. The braces 138 are welded to the base plate 131 and support the plate 131 along its span between its end connections to the support plates 125.

A pair of slat guide arms 144 (FIGS. 2 and 3) project within the slat hopper at each side of its rear wall plate 128 and are pivotally connected at 145 to one of the plurality of transverse angle iron support members 127. The movable slat guides 144 are pivotally movable in a counterclockwise direction (as viewed in FIG. 3) about their pivot connections 145, by means of a linkage apparatus generally designated at 146 which is connected to a rod 147 transversely extending between and rotatably mounted through the pair of brace members 138. One end of a lever arm 148 is securely clamped to the rod 147, and its other end is pivotally attached to a piston rod 149 of a hydraulic ram cylinder 150 which is mounted to the plate 137. The slat guide arms engage and urge any slats in the lower portion of the slat hopper toward engagement with the forward wall (plate 120) of the hopper as follows. As the piston 149 of the ram cylinder 150 moves in an extending direction, the rod 147 is caused to rotate in a counterclockwise direction (FIG. 3), thus causing by means of the linkage elements 146, the pair of lower slat guide arms 144 to rotate in a counterclockwise direction (FIG. 3) about their pivot points 145 and urging the lower portion of the arms 144 toward the plate 120.

A slat board advancing plate (or conveyor) 160 is generally inversely configured with respect to the bottom plate 131 and slidably rests thereon as illustrated in FIG. 2. The advancing plate 160 has a pair of longitudinally extending slots 161 formed therein and projecting from that edge of the plate 160 oriented toward the receiving end 51 of the system, to enable longitudinal movement of the plate 160 without interference by the brace members 138. Referring to FIG. 2, the lower side of the plate 160 is keyed along its longitudinally extending side edges for matingly engaging and longitudinally sliding within the pair of races 132 formed by the plate 131.

The upper surface of the slat advancing plate 160, along both of the side edges thereof, is notched in "rack" gear manner at 163 (FIGS. 2, 3 and 5). A pair of mating "pinion" gears 164 are oriented to matably engage the rack gears 163 on the plate 160 (see FIGS. 2 and 5). The pinion gears 164 are connected for unified rotation by means of an axle 165 transversely extending between and journaled for rotation in the pair of outer support plates 125. The axle 165 is also journaled for rotation through the pair of downwardly extending brace members 138. One end of the axle 165 projects through the rightmost (as viewed in FIG. 2) one of the support plate 125 and terminates at a sprocket 170.

A reversible slat feed motor 175 is mounted to the plate 137, and upon energization, rotates a drive sprocket 176 by means of a shaft 177 journaled through that same support plate 125 through which the axle 165 projects. In the preferred embodiment, the motor 175 is a hydraulically operated motor whose direction of rotation is controlled by means of a reversing solenoid 178 mounted to the plate 137 (note: the interconnections between the motor 175 and the solenoid 178 are not illustrated).

Figure 4:
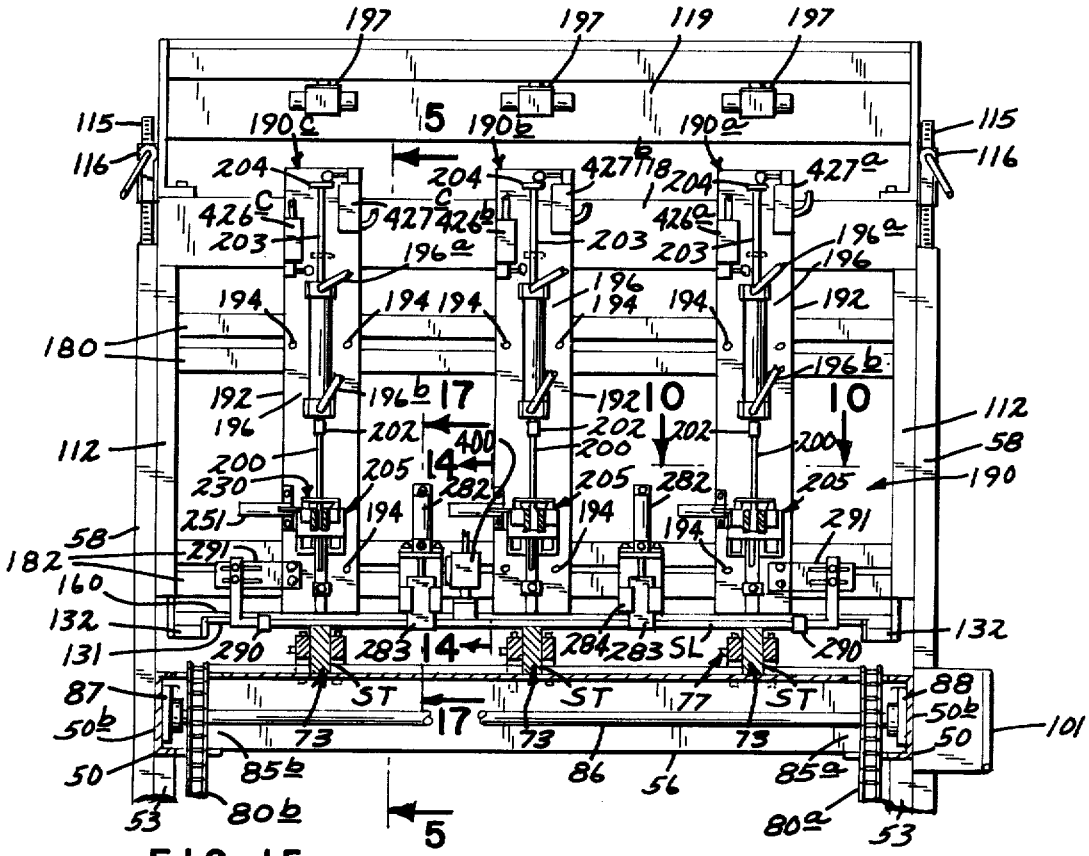
FIG. 4, Sheet 3, is an enlarged vertical sectional view of the device of FIG. 1, as generally taken along the section line 4—4 of FIG. 1.

Referring to FIGS. 4 and 5, two pairs of channel iron cross members transversely extend between and are connected at their ends to the delivery end (52) oriented sides of the support members 112. The upper pair of these cross members are labeled as 180, and the lower pair of cross members are labeled as 182. The members of each pair of cross supports 180 and 182 are disposed in parallel spaced apart relationship with one another, the spacing between cooperating ones of each pair of the cross members being sufficient to allow the shank of an adjustment bolt to slide longitudinally therebetween along the length of the cross members. Those surfaces of the cross members 180 and 182 which are oriented toward the delivery end 52 of the system are vertically aligned in generally planar relationship with that outer edge of the first cross support beam 118 which is also oriented toward the delivery end 52 of the system. The cross support beam 118 and the two pairs of channel iron cross members 180 and 182 collectively form mounting surfaces for the nailing units (to be hereinafter described) of the present invention.

In the preferred embodiment, a plurality of automatic nailing units generally designated at 190 (FIGS. 1, 4 and 5), are adjustably mounted to the cross members 180 and 182 in predetermined spaced relationship to one another. Each of the nailing units 190 is operatively associated with one of the plurality of the stringer magazine units 73 and is alignable therewith as hereinafter described. Since, in the preferred embodiment, there are three stringer magazine units 73, there also are three nailing units individually identified as 190A, 190B and 190C. That area laterally extending across the system at which the nailing units 190 are located is generally termed the "nailing station" of the system.

Since each of the nailing units 190 is identical in construction and operation, the details of only one of such nailing units will be described, it being understood that identical considerations are also applicable to the other two. Referring to FIGS. 1, 4 and 5, each nailing unit 190 generally has a vertically oriented mounting plate 192 adjustably connected to the pair of cross mounting members 180 and 182 by means of a plurality of bolts 194 threaded into the mounting plate 192 and having shanks which project between the slots defined by the two pairs of cross members 180 and 182 and are slidable therein. Those ends of the bolts 194 projecting toward the receiving end 51 are capped by enlarged heads. Each mounting plate 192 when securely fastened by means of the mounting bolts 194 engages those surfaces of the first cross beam 118, and of the cross member 180 and 182 which are oriented toward the delivery end 52 of the system. The adjustment bolts 194 may be loosened to enable "sideways" adjustment longitudinally along the support members 180 and 182 for aligning the nailing units 190, as hereinafter described, with the pair of base support guides 74 of the associated stringer magazine unit 73.

Each nailing unit 190 generally comprises a ram cylinder 196 mounted to the plate 194 such that the piston of the cylinder moves in a generally vertical up and down fashion. In the preferred embodiment, the nailing cylinders 196 are hydraulically operated ram units operative in a manner well known in the art, having a pair of hydraulic fluid hoses 196*a* and 196*b* operatively extending from the longitudinally opposing ends of the cylinder and operatively connected to (connections not illustrated) a reversing valve 197 mounted thereabove to the upper cross beam 119.

A drive rod 200 is operatively connected with and downwardly extends from the piston of the ram cylinder 196 and forms a "nailing hammer" 201 (FIG. 11) at its lower terminal. The hammer end 201 portion of the rod 200 extends within a "nailing head" assembly, generally designated at 205. The drive rod 200 further has a shoulder 202 positioned longitudinally therealong so as to clear the bottom of the cylinder 196 when the drive rod 200 is in its uppermost position, illustrated in FIGS. 1, 4 and 5. The upper end of the piston within the ram cylinder 196 is directly connected to a second rod member 203 which is movable therewith. The upper end of the rod 203 terminates with a cam 204 for operatively actuating toggle arms of a pair of electrical limit switches associated therewith, as hereinafter described.

Figure 11:
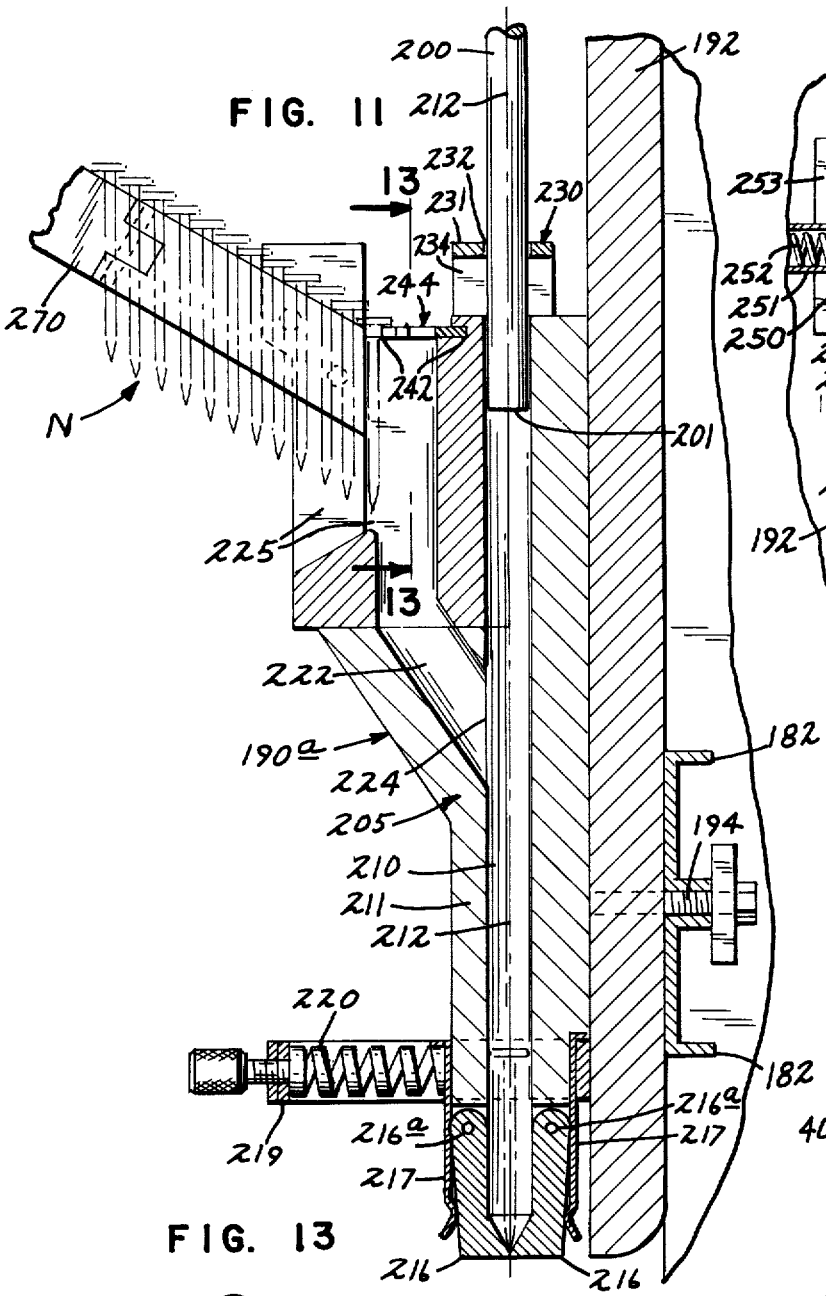
FIG. 11, Sheet 7, is a view in vertical section of the nailing head of FIG. 10, as generally taken along the section line 11—11 of FIG. 10, illustrating the internal construction of the nailing head.

A detailed cross-sectional view of one nailing head assembly 205 of the nailing unit 190 is illustrated in FIG. 11. Referring to FIG. 11, the shaft 200 slidably extends within a cylinder guide 210 vertically extending within a housing 211 of the nailing head assembly 205. The nailing hammer end 201 of the drive rod 200 is shown in FIG. 11 in its uppermost or "retracted" position.

Referring to FIG. 11, the lowermost portion of the guide cylinder 210 formed by the nailing head assembly housing 211 comprises a pair of cooperating jaw elements 216 pivotally mounted to the housing 211 and biased toward one another by means of a pair of leaf-spring elements 217 to a normally "closed" position as illustrated, thereby normally closing the lower end of the guide cylinder 210 and forming a chuck for holding nails during the nailing process. The leaf-spring elements 217 are maintained in the position illustrated in FIG. 11 by means of a U-shaped bracket clamp 219 which engages the upper portions of the spring elements 217. The clamp 219 has an adjustable bias spring generally designated at 220 for adjusting the tension upon the spring leaf elements 217. The lower end portions of the spring leaf elements 217 are yieldingly movable against pressure exerted thereon by the pair of jaw elements 216 as they pivot about their pivot points 216*a*. The inwardly directed lower portions of the jaw elements 216 are cammed in a downwardly converging (conical) manner about and toward the longitudinal axis 212 of the guide cylinder 210.

Figure 12:
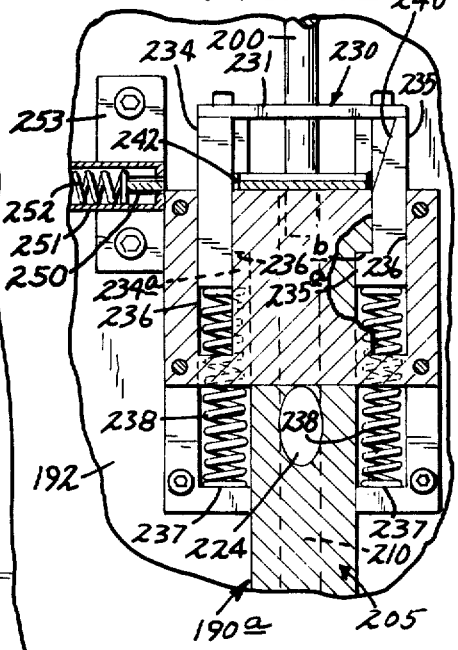
FIG. 12, Sheet 7, is a view in vertical section of the nailing head of FIG. 10, as generally taken along the section line 12—12 of FIG. 10, further illustrating the internal construction of the nailing head.

The housing 211 of the "nailing head" assembly 205 defines a nail feed channel 222 adjacent the guide cylinder 210. The feed channel 222 downwardly angles toward and opens into the guide cylinder 210 at an elongated opening 224 (FIGS. 11 and 12). The feed channel 222 is sufficiently large to enable a nail to be guided therethrough and to proceed under the force of gravity through the opening 224 and downwardly into the guide cylinder 210.

The housing 211 is slotted at 225, forming an elongated opening into the nail feed channel 222. A nail track guide 270 (to be described hereinafter in more detail) is anchored to the housing 211 adjacent the slotted opening 225 such that the space between the tracks of the guide 270 align with the slot 225.

Figure 13:
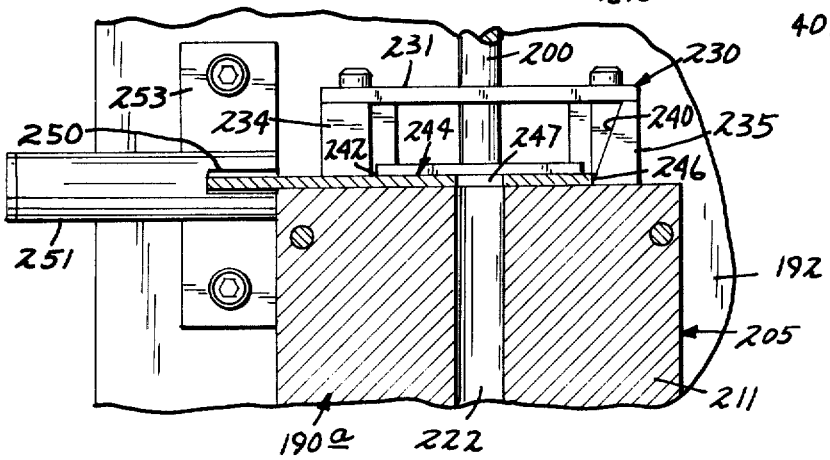
FIG. 13, Sheet 7, is a view in vertical section of that portion of the nailing head mechanism shown in FIG. 11, as generally taken along the section line 13—13 of FIG. 11.

Referring to FIGS. 10, 11, 12 and 13, an inverted U-shaped actuator plunger member 230 is generally disposed at the top portion of the nailing head assembly 205. The actuator 230 generally has a top plate 231 having a circular hole 232 formed therein and axially aligned with the axis 212 of the guide cylinder 210, for allowing unimpeded vertical motion of the drive rod 200 therethrough. The actuator 230 further has a pair of downwardly projecting wall members 234 and 235 connected to the top plate 231, which are vertically movable within a pair of cooperating races 236 defined by the housing 211, each of the housing races terminating at a bottom surface 237. Each of the wall portions 234 and 235 of the actuator member 230 terminates at its lower end with an enlarged shoulder element, 234*a* and 235*a* respectively, sized for vertical travel within the lower portions of the races 236. Each of the races 236 has a mating shoulder, which narrows the width of the upper portions of the races 236 and defines a stopping surface 236*a* for matingly engaging the enlarged shoulder elements 234*a* and 235*a* of the walls 234 and 235 respectively to define the upper limit of vertical motion of the actuator member 230. A pair of coil spring elements 238 are compressed within the races 236 between their bottom surfaces 237 and the bottom ends of the enlarged shoulder portions 234*a*and 235*a* of the actuator walls 234 and 235 respectively, normally urging the actuator assembly 230 in an upward direction (as illustrated in FIGS. 11, 12 and 13). The actuator 230 is illustrated in FIG. 12 in its uppermost position with the stopping elements 234*a* and 235*a* in resting engagement against the stopping surfaces 236*b* of the races 236, under the bias of the springs 238.

Referring to FIG. 12, the upper inwardly directed portion of the wall member 235 of the actuator 230 has a camming surface 240, vertically upwardly sloping from a position intermediate the length of the wall member 235 in a direction toward the outwardly directed surface of the wall member 235, terminating at the bottom surface of the top plate 231.

Figure 15:
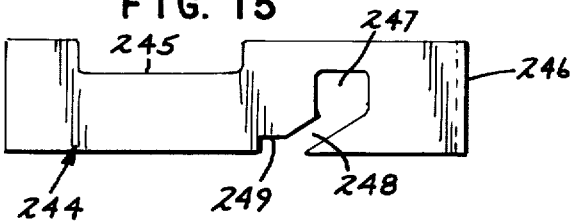
FIG. 15, Sheet 3, is a plan view of a gate member used in each nailing head of the present invention to control the supply of nails thereto.

The housing 211 defines a pair of parallel elongate slots 242 oppositely disposed to one another near the top of and on either side of the nail feed channel 222, for slidably retainably engaging a nail gate member 244 therebetween (FIG. 11). The gate 244 is illustrated in more detail in FIG. 15. Referring to FIG. 15, the gate 244 generally comprises: a generally rectangular sheet material element having a recessed portion 245 longitudinally extending along a portion thereof, a cammed end 246 and an aperture 247 extending therethrough and connected by means of an obliquely oriented passage 248 to a notch 249 formed in one of the longitudinally extending edges of the gate 244.

The gate 244 is sized to slide in its longitudinal direction within the pair of slots 242, enabling the cammed surface 246 of the gate 244 to matably engage and ride upon the cammed surface 240 of the wall 235 of the actuator 230. The "forward" motion of the gate 244 is, therefore, defined by the cammed surface 240 of the wall 235 of the actuator 230. The recessed portion 245 in the gate 244 is sized to enable free sliding movement of the gate 244 past the wall 234 of the actuator 230 (see FIG. 10).

Figure 16:
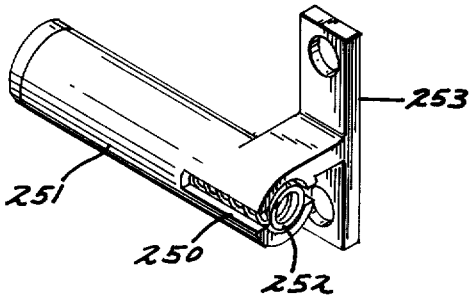
FIG. 16, Sheet 3, is a view in perspective of a biasing means for the gate member shown in FIG. 15.

That end of the gate member 244 oppositely disposed from its cammed end 246, slidably engages and rides within an elongated slot 250 (FIGS. 12 and 13) formed in one end of a cylindrical spring housing 251. The housing 251 (illustrated in detail in FIG. 16) retainably mounts a coil spring 252 therein and has a bracket member 253 integrally forming a part thereof. The spring housing 251 is bolted by means of the bracket 253 to the mounting plate 192 such that the slot 250 of the housing 251 is aligned in cooperating relationship with the parallel pair of elongated slots 242 of the housing 211. The gate member 244 slidably simultaneously engages both the slot 250 and the slots 242 and is normally urged under the bias of the spring 252 toward engagement with the camming surface 240 of the wall 235 of the actuator 230.

The gate 244 is illustrated in FIG. 10 in its leftmost (retracted) position, corresponding to that situation wherein the actuator 230 is in its uppermost position.

The notch 249 in the gate element 244 is positioned longitudinally along the gate 244 (see FIG. 10) such that when the gate element 244 is positioned in its rightmost position the notch 249 will align with the central opening of the nail track guides 270.

Referring to FIGS. 1 to 9, a bridge support base 260, mounted at its ends to the pair of elongate frame rail beams 50 spans the width of the assembly and mounts a nail orienting and supplier apparatus, generally designated at 262, thereon. The bottom of that portion of the bridge support structure 260 which overlies the generally planar "bed" of the system is sufficiently elevated thereabove to enable free movement of completed pallets longitudinally advancing along the bed thereunder.

The nail orienting and supplier apparatus 262 may be of any type known in the art which functions generally to continuously supply properly oriented nails to a plurality of outputs for use by the automatic nailing units 190. In the preferred embodiment, the nail orienting and supplier apparatus 262 has a conically shaped hopper 264 having a plurality of spiraled grooves 266 circumferentially formed therein, for accepting a plurality of nails. A vibrating motor 267 is mounted to the base of the hopper 264 and provides vibrating oscillatory motion to the hopper 264 in such a manner so as to enable nails within the lowermost part of the hopper 264 to be moved to the high outmost grooves 266 of the bowl where they are properly oriented (in the preferred embodiment, point first). In the preferred embodiment, the hopper 264 has three outlet ports 268*a*, 268*b* and 268*c*.

The nail track guides 270 are connected adjacent each of the outlet ports 268 of the hopper 264 to accept nails thereat. In the preferred embodiment, the nail track guides each comprise a pair of parallel tracks, spaced apart a sufficient distance to enable the shank of the nail to slidingly proceed therebetween while the head of the nail rests upon and slidingly moves upon the upper surfaces of the spaced tracks. The spacing between the cooperating tracks of each of the nail guides 270 is adjustable to accommodate nail shanks of varied sizes. The nail track guides 270 downwardly incline from the hopper 264 to the respective nailing head assemblies 205 of the nailing units 190 - one each of the nail track guides 270 being connected to one each of the nailing head assemblies 205 for supplying nails thereto. Referring to FIGS. 10 and 11, the lower terminis of each of the nail track guides 270 is connected to the housing 211 of the respective nailing head unit 205 such that the central race between the tracks of the guide 272 aligns with and opens directly into the slotted opening 225 feeding into the nail feed channel 222 of the nailing head unit 205. The slotted opening 225 in the housing 211 is of sufficient length to enable the unobstructed movement (except for the gate member 244 as hereinafter described) of a shank of a nail — illustrated in phantom at "N" in FIG. 11 — to pass into the nail feed channel 222.

Referring to FIG. 9, each of the plurality of outlets 268 of the nail hopper 264 has an electrically operated solenoid 278 aligned at the respective outlets 268 such that when the plunger of one of the solenoids 278 is activated in its extended position, the plunger will block further movement of nails out of that outlet into the connecting nail guide. Each of the solenoids 278 is operatively connected to a sensor 279, one each of said sensors being mounted on each of the nail track guides 270 at a predetermined distance therealong so as to be activated by a nail head passing thereby. In the preferred embodiment, microswitch sensors are employed for this purpose, although other types of sensors could equally well be employed within the spirit and intent of this invention. Each of the microswitches 279 is respectively connected to that solenoid 278 which is mounted adjacent that same nail guide member 270 to which both are connected, and operatively energizes the solenoid 278 in response to the movement of nails along the nail guide 270, as hereinafter described.

Figure 17:
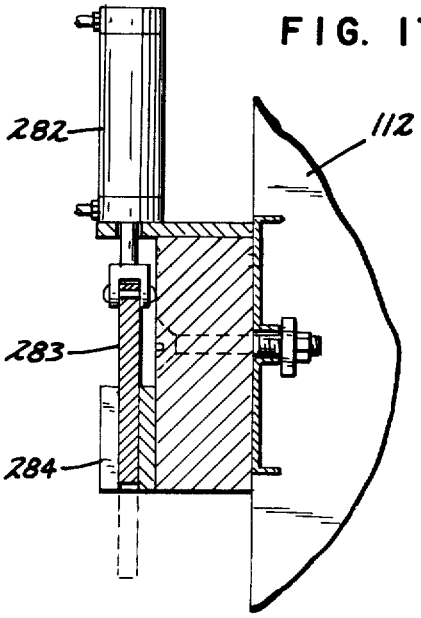
FIG. 17, Sheet 3, is a view in vertical section of a portion of the device shown in FIG. 4, generally taken along the section line 17—17, illustrating a slat stopping member employed in the present invention for positioning a slat prior to nailing the underlying stringer members.

Referring to the nailing station, mounted between the center and outermost nailing units 190, and in general lateral alignment at the nailing station, are a pair of hydraulically operated slat stop pistons 282 (FIG. 4). THe slat stop pistons 282 are mounted to the lower pair of channel iron cross members 182 such that the piston travel of the units 282 is in a generally vertical direction. The pistons of the slat stop pistons 282 are illustrated in FIG. 4 in their uppermost positions. A detailed side elevational view of one of the slat stop pistons 282 is illustrated in FIG. 17. Each of the slat stop pistons 282 has a stop element 283 connected to the lower portion of the piston. When the piston is extended in its lowermost position, the stop element 283 connected therewith extends in the path of a slat board (SL) riding on top of the advancing stringers (ST) to prevent movement of that slat past nailing positions under the nailing units at the nailing station. Both of the slat stop pistons 282 are simultaneously operated by means of a single reversing valve (not illustrated). A guide bracket 284 guides the vertical travel of the stop elements 283 and protects the pistons 282 from damage caused by forces exerted upon the stop elements 283.

Referring to FIGS. 4 and 6, a pair of slat centering guide elements, generally designated at 290 are adjustably mounted to the mounting plates 192 of the two outermost positioned nailing units 190*a*a 190*c*. The slat centering guides 290 are adjustably mounted to the base mounting plates 192 of the respective nailing units to which they are attached by means of brackets 291, and are employed to center a slat board (SL) being presented to the nailing stations therebetween. A detailed top elevational view of one of the slat centering guides 290 is illustrated in FIG. 8. Referring to FIG. 8, it will be noted that the slat centering guide comprises a pivotally connected cam member 292 normally urged in clockwise rotation about its pivot point 292*p* by means of a leaf-spring element 293. The clockwise motion of the cam 292 is limited by a flange extension 292*a* of the cam 292 which engages the bracket that houses the slat centering guide assembly 290.

The automatic stitch nailing system is controlled by an electrical control system. In the preferred embodiment, the control circuits respond to a plurality of conditions and sequential events initiated by the toggling of a plurality of limit switches throughout the system. To facilitate the latter discussion of the electrical control schematic, the physical locations and mechanics of operation of the plurality of limit switches will first be described.

Figure 14:
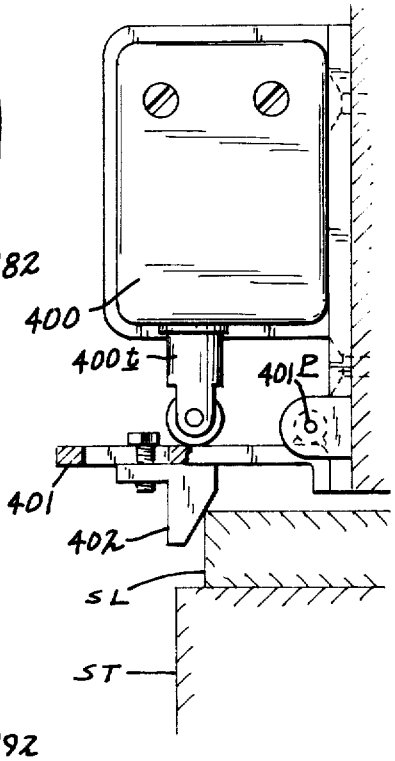
FIG. 14, Sheet 7, is an enlarged view in vertical section of a portion of the device shown in FIG. 4, as generally taken along the section line 14—14 of FIG. 4, illustrating a limit switch for positioning a slat to be nailed to a plurality of underlying stringer members.

Referring to FIG. 4, a limit switch 400 is secured to the lower pair of cross beams 182 at the nailing station. A detailed view in side elevation, of the limit switch 400 is illustrated in FIG. 14. Referring to FIG. 14, the limit switch 400 has a vertically movable toggle arm 400*t* which rides upon the top surface of a lever arm 401. The lever arm 401 is pivotally mounted at 401*p* to an extension of the switch 400 chassis, and has a flanged portion adjacent its pivotal connection point to prevent pivotal motion in the counterclockwise direction beyond that position in which it appears in FIG. 14. The lever arm 401 has a cam element 402 protruding from its lower surface and extending therebelow a sufficient distance to engage a slat board (SL) riding upon a longitudinally advancing stringer (ST). In FIG. 14, the stringer (ST) and slat (SL) boards advance from right to left. As the slat (SL) advances, the cam element 402 rides up upon the top surface of the slat, causing the lever arm 401 to rotate in a clockwise direction about its pivot point 401*p* imparting vertical upward actuating motion to the toggle arm 400*t* of the limit switch 400.

The rightmost chain 80*b*, when viewed from the receiving end 51 of the system, is adapted to receive cam members on its non-roller edges (see FIGS. 6, 18, 19 and 20). The cam elements are removably attachably to the chain 80*b* for movement therewith and can be secured to the chain at spaced intervals therealong. Referring to FIGS. 18 and 19, the chain 80*b* comprises a plurality of cylindrical rollers 405 linked together by a plurality of links 406 at their ends, such that the central holes 407 of the cylindrical rollers 405 are accessible. Cam elements are mounted to the chain 80*b* by means of U-shaped cam mounting brackets 408 which have a pair of parallel leg portions 408*a* and 408*b* which matingly align with and are insertable within the central holes 407 of successive ones of the rollers 405 (see FIG. 18) in telescopic-like fashion. The cam mounting bracket 408 is securely attached to the body of the cam element which is to be attached to the chain 80*b*.

In the preferred embodiment the cam members 410 are secured to the "outside" of the chain 80*b* are of peculiar design for sequentially activating a plurality of limit switches, as hereinafter described. That portion of the chain 80*b* illustrated within the circle "C" in FIG. 6, which contains a cam 410 in cooperative engagement with a plurality of limit switches, is illustrated in more detail in FIG. 18, with portions thereof broken away. Referring to FIG. 18, the cam element 410 illustated has three outwardly projecting cam surfaces labeled 411, 412 and 413. As viewed in FIG. 18, the chain 80*b* operatively advances from right to left. The cam element 410 further has an upper cammed surface illustrated in profile in FIG. 19 and numerically designated as 414. In the preferred embodiment, each of the cam elements 410 attachable to the outside of the chain 80*b* has only one "upper" cammed surface 414, while the number of "outwardly" directed cammed surfaces (i.e., 411, 412 and 413) varies with the nailing requirements of the specific item being produced. As hereinafter described, the outwardly directed cam surfaces (411, 412 and 413) of the cam element 410 are generally termed as "nailing" cams while the upwardly directed cam surface 414 is termed the "slat-feed" cam.

Referring to FIGS. 6 and 18, the outwardly directed cam surfaces 411, 412 and 413 of the cam member 410 actuate toggle arms (*t*) of a first limit switch 420 and of a second limit switch 422 which are cooperatively attached to the frame rail member 50 so as to engage the cammed surfaces 411, 412 and 413 as they adavnce with the chain 80*b*. A third limit switch 424 is mounted above the path of the cam elements 410 as they proceed with the chain 80*b* and is aligned therewith such that its toggle arm 424*t* is operatively engaged and activated by the upper cam surfaces 414 of the cams 410. The cooperative sequential activation relationship between the second and third limit switches 422 and 424 respectively and one of the cam elements 410 is illustrated in end view in FIG. 20.

The chain 80*b* also has a cam member 415 attached to its inwardly directed surface. The cam member 415 is detachably connectable so as to be placed at any predetermined position along the length of the chain 80*b* in like manner as previously discussed with respect to the attachment of the cams 410. As viewed in FIG. 6, the cam 415 travels from right to left with the chain 80*b* and actuates the toggle arm (*t*) of a limit switch 425 mounted to the frame rail 50 in the general proximity of the limit switches 420, 422 and 424.

Referring to FIG. 4, each of the nailing units 190A, 190B and 190C has a pair of limit switches 426 and 427 secured to the mounting plate 192 near the upper end of the ram cylinder 196, and aligned with the cam 204 on the upper rod 203 so as to be operatively toggled thereby. The upper one 427 of each pair of limit switches has its toggle arm positioned relative the cam 204 on the rod 203 so at to be activated whenever the piston of the cylinder 196 is in its uppermost position. The lowermost one 426 of each pair of limit switches on a nailing unit 190 has its toggle arm positioned relative the travel of the cam 204 so as to be operatively toggled whenever the piston of the nailing cylinder 196 is in its lowermost (nailing) position. For later reference, the respective limit switches 426 and 427 have been designated by the suffixes *a*, *b* and *c* to respectively correspond to the three nailing untis 190A, 190B and 190C.

Referring to FIG. 5, a limit switch 428 is mounted to one of the support plates 125 and is positioned such that its toggle arm is operatively activated by the rightmost end (as viewed in FIG. 5) of the slat board advancing plate 160 when it is in its rightmost (retracted) position.

Figure 21:
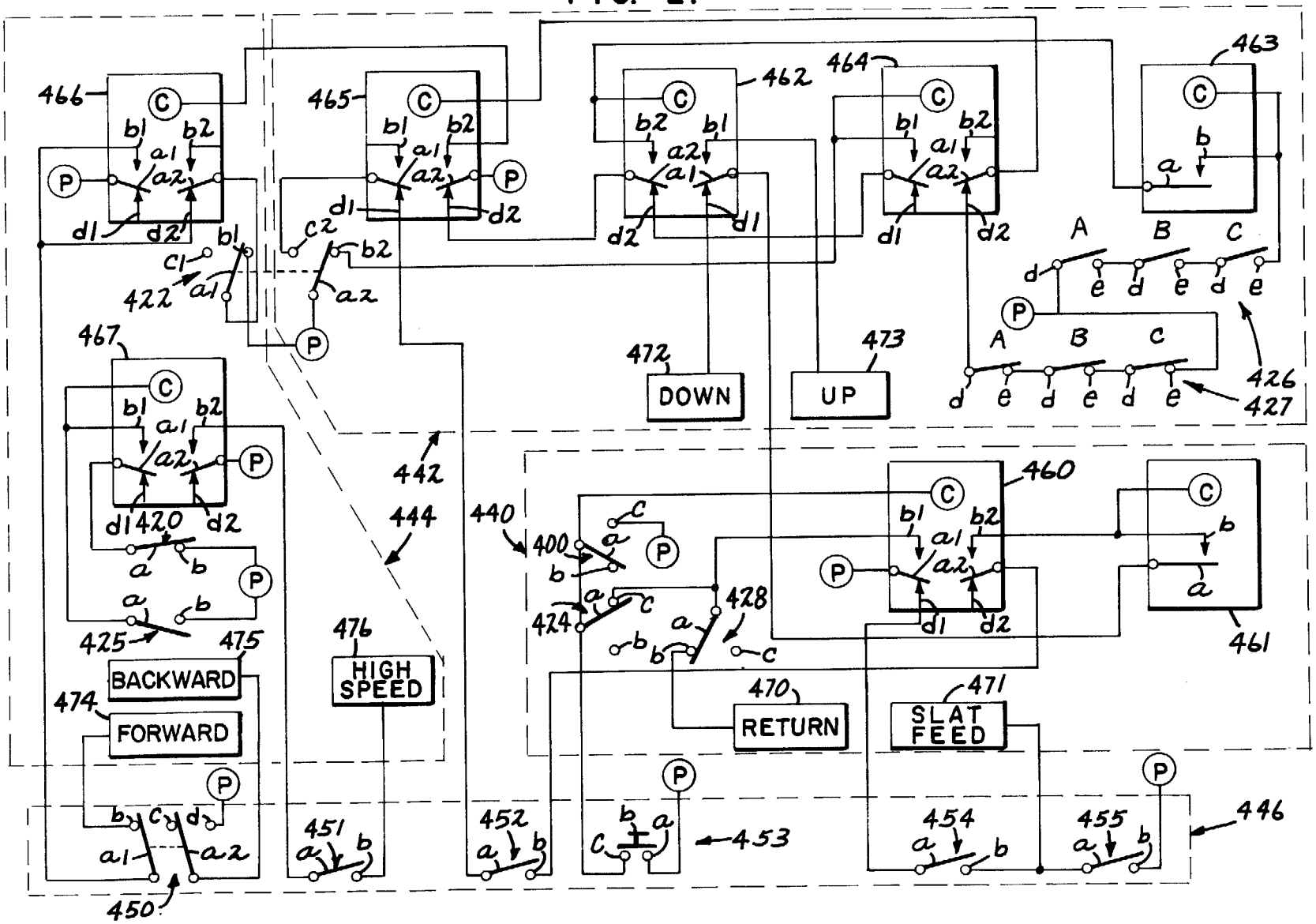
FIG. 21, Sheet 8, is a schematic diagram illustrating the major functional circuits of the electrical control portion of the present invention.

The electrical control circuits are schematically represented in FIG. 21 (sheet 8) of the drawings. Referring to FIG. 21, the control circuits are generally divided into the following functional blocks: the slat feed circuit 440, the nail control circuit 442 and the conveyor control circuit 444. A plurality of manually operable switches for the control circuits are mounted on a master control panel 446 (FIG. 1) and have been included within a dashed line of like designation, for convenience of reference in FIG. 21.

To simplify the description of the electrical schematic, the energizing power sources for the circuits have been designated by an encircled "P" throughout the schematic, it being understood that an appropriate connection to a power source is intended by such references. Further, electrical solenoids for energizing the pneumatic motors and controls throughout the system will be referred to as rectangular blocks, each designated by a word therein depicting the specific function of that solenoid. A plurality of normal switching relays and time delay switching relays are employed throughout the control circuits. The normal switching relays are of the type having a coil generally designated as *c*, a pair of armatures (designated as *a*1 and *a*2), a first pair of contacts (designated as *b*1 and *b*2), and a second pair of contacts (designated as *d*1 and *d*2). For convenience in reading the electrical schematic, the first pair of relay contacts *b*1 and *b*2 schematically illustrated above the pair of armatures *a*1 and *a*2 in the schematic will be referred to as "upper" contacts, while the second pair of contacts *d*1 and *d*2 schematically illustrated below the armatures *a*1 and *a*2 of the relays will be referred to as the "lower" contacts. The time delay relays employed within the control circuits are of the type having an energizing coil (designated as *c*), an amature (designated as *a*) and a single contact (designated as *b*). Further, the positions of the armatures of the relays shown in FIG. 21 relative the upper and lower contacts thereof, are illustrated in those positions they would assume when the coils (*c*) of the relays are de-energized.

The plurality of manual control switches on the master control panel 446 of the system comprise: a double pole single throw "direction" switch 450, a "high speed enable" switch 451, a "nailing enable" switch 452, a push-button "start" switch 453, a "slat feed enable" switch 454 and a "manual slat feed" switch 455. All of these manually controlled switches (450–455) are physically located upon the control panel 446 of the system and are readily accessible to an operator of the system.

Referring to FIG. 21, the system start switch 453 has a first stationary contact 453*a* directly connected to the power supply (P), a movable contact 453*b* and a second stationary contact 453*c*. The second stationary contact 453*c* is directly connected to a movable toggle contact 424*a* of the normally closed limit switch 424, to a movable toggle contact 400 of the limit switch 400 and to a coil 460*c* of a first switching relay 460. The relay 460 further has a pair of armatures (*a*1 and *a*2), a pair of upper contacts (*b*1 and *b*2) and a pair of lower contacts (*d*1 and *d*2).

The limit switch 400 further has a first stationary contact 400*b* and a second stationary contact 400*c* which is directly connected to the power source (P). The movable contact 400*a* of the limit switch 400 is normally positioned to close the circuit with its first stationary contact 400*b*.

The limit switch 424 also has a first stationary contact 424*b* and a second stationary contact 424*c* which is directly connected to a first upper contact 460(*b*1) of the switching relay 460. The movable contact 424*a* of the limit switch 424 is normally in electrical circuit with its second stationary contact 424*c*.

The second stationary contact 424*c* of the limit switch 424 is also directly connected to a movable toggle contact 428*a* of the normally closed limit switch 428. The limit switch 428 further has a first stationary contact 428*b* and a second stationary contact 428*c*, The movable contact 428*a* of the limit switch 428 is normally in engagment with its first stationary contact 428*b* which is directly connected to energize a "return" solenoid 470.

The first armature 460(*a*1) of the relay 460 is directly connected to the power source(*p*). The first lower contact 460(*d*1) of the relay 460 is directly connected to a movable contact 454*a* of the slat feed enable switch 454. The switch 454 further has a stationary contact 454*b* which is directly connected to energize a "slat feed" solenoid 471. The stationary contact 454*b* of the switch 454 is also directly connected to a movable contact 455*a*of the manual slat feed switch 455. The switch 455 further has a stationary contact 455*b* directly connected to the power source (P).

The second lower contact 460(*d*2) of the relay 460 is unconnected. The second upper contact 460(*b*2) of the relay 460 is directly connected to a coil 461(*c*) of a first time delay relay 461. The time delay relay 461 further has an armature 461(*a*) and a contact 461(*b*) which is also directly connected to the coil 461(*c*) of the relay 461. The armature 461(*a*) of the relay 461 is directly connected to a first armature 462(*a*1) of a second switching relay 462.

The relay 462 further has a coil 462(*c*), a second armature 462(*a*2), a pair of upper contact 462(*b*1 and *b*2) and a pair of lower contacts 462(*d*1 and *d*2). The first lower contact 462(*d*1) of the relay 462 is directly connected to energize a "down" solenoid 472. The first upper contact 462(*b*1) of the relay 462 is directly connected to energize an "up" solenoid 473.

The second upper contact 462(*b*2) of the relay 462 is driectly connected to its coil 462(*c*). The coil 462(*c*) of the relay 462 is also directly connected to an armature 463(*a*) of a second time delay relay 463. The second time delay relay 463 further has a coil 463(*c*) and a contact 463(*b*) which are in direct electrical circuit with one another.

The second lower contact 462(*d*2) of the relay 462 is directly connected to a first armature 464(*a*1) of a third switching relay 464. The relay 464 further has a second armature 464(*a*2), a coil 464(*c*), a pair of upper contacts 464(*b*1 and *b*2) and a pair of lower contacts 464(*d*1 and *d*2).

The first upper contact 464(*b*1) and the coil 464(*c*) of the relay 464 are directly connected. The first lower contact 464(*d*1) of the relay 464 is unconnected. The second upper contact 464(*b*2) of the relay 464 is unconnected. The second lower contact 464(*d*2) is directly connected to a movable contact 427A(*d*) of the normally closed limit switch 427A. The limit switch 427A also has a stationary contact 427(*e*) directly connected to a movable toggle arm contact 427B(*d*) of the normally closed limit switch 427B. The limit switch 427B further has a stationary contact 427B(*e*) directly connected to a movable toggle arm contact 427C(*d*) of the limit switch 427C. The limit switch 427C further has a stationary contact 427(*e*) directly connected to the power source (P) and also directly connected to a movable contact 426A(*d*) of the normally open limit switch 426A.

The limit switch 426A also has a stationary contact 426A(*e*) directly connected to the movable contact toggle arm 426B(*d*) of the limit switch 426B. The limit switch 426B further has a stationary contact 426B(*e*) directly connected to the movable toggle arm 426C(*d*) of the limit switch 426C. The limit switch 426C further has a stationary contact 426C(*e*) directly connected to the coil 463(*c*) of the second time delay relay 463.

The second armature 464(*a*2) of the relay 464 is directly connected to a coil 465(*c*) of a fourth switching relay 465. The switching relay 465 further has a pair of armatures 465(*a*1 and *a*2), a pair of upper contact 465 (*b*1 and *b*2) and a pair of lower contact 465 (*d*1 and *d*2). The first upper contact 465(*b*1) is unconnected. The first lower contact 465(*d*1) of the relay 465 is directly connected to a movable contact 452*a* of the nailing enable switch 452. The nailing enable switch 452 further has a stationary contact 452*b* which is directly connected to the second armature 460(*a*2) of the switching relay 460.

The second armature 465(*a*2) of the fourth switching relay 465 is directly connected to the power supply (P). The second lower contact 465(*d*2) of the relay 465 is directly connected to the second armature 462(*a*2) of the second switching relay 462. The second upper contact 465(*b*2) of the relay 465 is directly connected to a coil 466(*c*) of a fifth switching relay 466. The switching relay 466 further has a pair of armatures 466(*a*1 and *a*2), a pair of upper contacts 466(*b*1 and *b*2), and a pair of lower contacts 466(*d*1 and *d*2). The first armature 466(*a*1) of the relay 466 is directly connected to the power source (P). The first lower contact 466(*d*1) and the second upper contact 466(*b*2) of the relay 466 are unconnected.

The second armature 466(*a*2) of the relay 466 is directly connected to a first movable contact 422(*a*1) of the limit switch 422. The limit switch 422 is a double pole single throw switch having a second movable contact 422(*a*2) simultaneously movable with the first contact 422(*a*1) as illustrated by the dashed line therebetween. The first movable contact 422(*a*1) is movable between a first stationary contact 422(*b*1) and a second stationary contact 422(*c*1), and is normally engagable with the first stationary contact 422(*b*1), which is directly connected to the power source (P). The second stationary contact 422(*c*1) is unconnected.

The second movable contact 422(*a*2) of the limit switch 422 is movable between a first stationary contact 422(*b*2) and a second stationary contact 422(*c*2). The second movable contact 422(*a*2) of the limit switch 422 is directly connected to the power source (P), and is normally in engagement with the first stationary contact 422(*b*2) of the switch. The stationary contact 422(*b*2) of the switch 422 is directly connected to the coil 464(*c*) of the third switching relay 464. The stationary contact 422(*c*2) of the switch 422 is directly connected to the first armature 465(*a*1) of the fourth switching relay 465.

The first upper contact 466(*b*1) of the fifth switching relay 466 is directly connected to the second lower contact 466(*d*2) of the relay 466 and is also connected to a first movable contact 450(*a*1) of the direction switch 450. The direction switch 450 also has a second movable contact 450(*a*2) simultaneously movable with the first movable contact 450(*a*1). The first movable contact 450(*a*1) is movable between a first stationary contact 450*b* and a second stationary contact 450*c*. The second movable contact 450(*a*2) of the switch 450 is movable between the second stationary contact 450*c* and a third stationary contact 450*d* of the switch 450. The third stationary contact 450*d* is directly connected to the power source (P). The first stationary contact 450*b* of the switch 450 is directly connected to energize a "forward" solenoid 474. The second movable contact 450(*a*2) of the switch 450 is directly connected to energize a "backward" solenoid 475.

A sixth switching relay 467 having a coil 467(*c*), a pair of armatures 467(*a*1 and *a*2), and pair of upper contacts 467(*b*1 and *b*2), and a pair of lower contact 467(*d*1 and *d*2), has its coil 467(*c*) directly connected to its first upper contact 467(*b*1) and also directly connected to a movable contact 425*a* of the limit switch 425. The limit switch 425 is normally open, having a stationary contact 425*b* directly connected to the power supply (P).

The first armature (*a*1) of the relay 467 is directly connected to a movable wiper 420*a* of the limit switch 420. The movable wiper 420*a* of the switch 420 is in a normally closed position with a stationary contact 420*b* which is directly connected to the power source (P).

The pair of lower contact 467(*d* 1 and *d*2) of the relay 467 are unconnected. The second armature 467(*a*2) of the relay 467 is directly connected to the power source (P). The second upper contact 467(*b*2) of the relay 467 is directly connected to a movable contact 451*a* of the high speed enable switch 451. The switch 451 further has a stationary contact 451*b* directly connected to energize a "high speed" solenoid 476.

Referring to FIGS. 21, 4 and 6, the "forward" (474), the "backward" (475) and the "high speed" (476) solenoids are connected (not illustrated) to energize the first reversing motor 94 which drives the pair of endless conveyor chains 80*a* and 80*b*. The "down (472) and the "up" (473) solenoids are connected (not illustrated) to energize the reversing valves 197 which operate the ram cylinders 196 of the automatic nailing units 190. The "return" (470) and the "slat feed" (471) solenoids are connected (not illustrated) to energize the reversing valve 178 (FIG. 2) for the slat feed motor 175. The "slat feed" (471) solenoid is also connected (not illustrated) to energize the pair of slat stop pistons 282 (FIG. 4), such that when the solenoid 471 is energized, the slat stop pistons 282 downwardly extend their stop elements 283 in the path of an advancing slat board (SL).

OPERATION OF THE PREFERRED EMBODIMENT

In general, the automatic nailing system of the preferred embodiment simultaneously advances three parallel stringers (ST) along the three pairs of base support guides 74 of the stringer magazine units 73 toward the nailing station adjacent the automatic nailing units 190. As the stringers advance past the nailing station, slat boards (SL) are sequentially placed at spaced intervals thereupon, are aligned so as to lie generally perpendicular to the stringers and are automatically nailed in stitch nailing fashion to the advancing stringers by the automatic nailing units 190.

The apparatus of the automatic stitch nailing system may be adjusted to assemble stringer and slat assemblies of varied configurations including such factors as: (1) the length of the stringers (ST) — by adjusting the effective length of the pair of elongate frame rail members 50 by means of the cooperating adjustment slot 64 and bolt 62 apparatus; (2) the spacing between adjacent stringers — by adjusting the lateral position of the stringer magazine units 73 upon the first and second stringer magazine support members 67 and 70 respectively and by positioning the automatic nailing units 190 in alignment thereabove (3) the width (when placed on edge) of the individual dual stringer members — by adjusting the spacings between associated one of the pairs of base support guides 74 of each of the stringer magazine units 73; (4) the total height (thickness) of a pallet assembly (including the thickness of a stringer board when placed on edge plus that of a slat board secured thereto) — by adjusting the movable assembly including the nailing head units 190 and the slat supplying apparatus, which is attached to the inner pair of U-shaped channel beams 112, via the rack and pinion adjustment apparatus 115 and 116 respectively; (5) the length of the transverse slat boards (SL) to be secured to the advancing stringers — by adjusting the slat end guide plates 129 of the slat hopper by means of the brackets 130 mounted within the plurality of angle iron support members 127 (FIG. 2); (6) the width of slat boards and the spacings between successive slat boards added to the advancing stringers — by positioning the cam elements 410 along the endless conveyor chain 80*b* at the desired positions; (7) the number of and spacing between nails that are stitch nailed into each respective slat board as it is secured to the advancing stringers — by placing cam elements 410 with preselected numbers of and relative spacing between "outwardly" directed cam surfaces (e.g., cam surfaces 411, 412 and 413) along the chain 80*b*; and (8) the size of nails to be used in securing the slat boards to the advancing stringers — by adjusting the spacing between associated ones of the three pairs of nail track guides 270.

Once the desired adjustments have been performed for the construction of a particular stringer and slat configuration according to the above outline, the automatic stitch nailing apparatus will automatically manufacture in repetitive fashion such stringer and slat configurations without further attention by an operator of the system except to add stringer boards (ST) to the plurality of stringer magazine units 73, to supply the slat hopper with slat boards (SL) and to supply the nail orienting and supply apparatus 262 with an become supply of nails.

Once the initial adjustments are complete, an operator of the system enables the automatic control circuits (FIG. 21) of the system by appropriate positioning of the switches 450, 451, 452, 453 and 454 on the master control panel 446 as will become apparent upon a more detailed description of the operation of the control system. Thereafter, the entire coordination of the stitch nailing apparatus is controlled by control circuits (FIG. 21) and the associated activating cam elements strategically located throughout the system. In general, the cam elements 410 are positioned along the conveyor chain 80*b* and relative the drive bar 82 at distances which are directly related to that length of the stringer boards (ST) to be used for a particular assembly configuration. For example, the foremost cam element 410 to cooperatively engage the first limit switch 420, is spaced relative the drive bar 92 (FIG. 6), by a predetermined longitudinal distance, determined by the length of the stringer board to be employed. The relative spacings between subsequent ones of the cam elements 410 and the individual configuration of their cammed surfaces will become clear upon a more detailed explanation of the control circuits operation.

Since it will aid in an understanding of the operation of the control circuits and of the system in general, a brief outline of the operative events in the assembly of a pallet follows. Stringer boards from the stringer magazine units 73 initially advance at a fairly rapid speed from the receiving end 51 of the system to its delivery end 52, under the guidance of the drive bar 92 connected to the conveyor chains 80. As the forward ends of the stringers approach the nailing station, cam elements 410 on the conveyor chain 80*b* sequentially toggle appropriate limit switches, to effect:

1. a reduction in speed of the advancing drive conveyor chains 80;

2. activation of the slat board feed assembly to accurately place a slat board transversely upon the advancing stringers at a predetermined longitudinal position therealong;
3. activation of the nailing sequence including:
   a. stopping the forward movement of the conveyor chains 80 when the slat board provided to the stringers is in proper position for nailing;
   b. simultaneously activating the plurality of automatic nailing units 190 to secure the slat board to the underlying stringers by driving nails into the slat board and underlying stringers;
   c. reloading the nailing head assemblies 205 of the automatic nailing units 190 for subsequent nailing operations, while longitudinally advancing the stringer and slat assemblies; and
   d. recycling the nailing operation in stitch-bond nailing fashion to place additional securing nails into the slat board and stringers at predetermined locations according to the specific configurations of the cam elements 410;
4. longitudinally advancing the stringers and attached slat boards a predetermined distance (as determined by the relative spacing between successive cam elements 410) at which time another slat board is added and nailed to the stringers as above described;
5. repeating the slat board addition and nailing sequence until the pallet is completed; and
6. upon completion of a pallet rapidly advancing a a new set of stringers to the nailing station and repeating the entire sequence for constructing another pallet.

Referring to FIG. 6, the conveyor chains 80*a* and 80*b* advance from right to left along the top of the plate bed 65, advancing the drive bar 92 secured therebetween along the top of the plate 65. The lowermost stringers positioned in the stringer magazine units 73 are in direct engagement with the top surface of the plate 65 and are free to longitudinally move therealong. As the drive bar 92 engages the rightmost (as viewed in FIG. 6) ends of the lowermost stringers within each of the stringer magazine units 73, it simultaneously advances those stringers from right to left longitudinally along and between the respective pairs of the base support guides 74. As the advancing stringers in each of the magazine units 73 approach the nailing station, they are urged toward sliding engagement with the leftmost base support guide 74 (as viewed from the receiving end 51) by means of the stringer positioning elements 77. Therefore, the stringers (ST) are laterally positioned with reference to the leftmost one of each pair of base support guides 74 of the stringer magazine units 73. In the preferred embodiment, the "foremost" cam 110 is positioned along the conveyor chain 80*b* such that its leading outwardly directed cam surface 411 (see FIGS. 6, 18, 19 and 20) engages the toggle arm 420(*t*) of the first limit switch 420 just as the leading ends of the stringer boards (ST) approach the nailing station.

The limit switches (referring to FIGS. 6, 18, 19 and 20) 420, 422 and 424 are longitudinally positioned relative one another and cooperatively engage the cam surfaces of the cam element 410 in sequential manner to activate the control circuits (FIG. 21) as below described.

The first reversing motor 94 is operable to cause the pair of conveyor chains 80*a* and 80*b* to advance along the top surface of the plate 65 (as illustrated in FIG. 6) via the drive sprocket 89 and associated linkage apparatus, at two speeds — a first relatively fast speed and a second much slower speed. That forward speed at which the motor advances the conveyor chains 80 is determined by the energization state of the sixth switching relay 467 of the conveyor control circuit 444 (FIG. 21). Referring to FIG. 21, it will be noted that the "high speed" solenoid 476 is activated when the relay 467 is energized, causing the second armature and second upper contacts 467(*a*2) and 467(*b*2) respectively of the relay 467 to actively engage one another. Whenever the high speed solenoid 476 is energized, the first reversing motor 94 is caused thereby to become operative in its relatively fast forward speed. Conversely, whenever the high speed solenoid 476 is de-energized, either by the opening of the switch 451 on the master control panel 446, or by the de-energization of the sixth switching relay 467, the motor 94 is caused to operate at the second much slower speed. It will be noted that for the high speed option to become active in any instance, the high speed enable switch 451 on the master control panel 446 must be closed; i.e., the operator must initially enable this portion of the system The high speed control circuit is generally operable as follows. The first limit switch 420 is normally operable (in its untoggled condition) in a closed position as illustrated in FIG. 21. The limit switch 425 (in its untoggled condition) is normally open, also as illustrated in FIG. 21. Under these conditions (and assuming that the high speed option is enabled by the closing of the high speed enable switch 451) the coil 467(*c*) of the sixth switching relay 467 is de-energized. To energize the coil 467(*c*) of the relay 467, the limit switch 425 must be momentarily closed. Assuming a toggling of the limit switch 425, and a momentary closing thereof, the coil 467(*c*) of the relay 467 will be energized, causing the armatures 467(*b*1) and 467(*a*2) to engage the upper contacts 467(*b*1) and 467(*b*2) of the relay 467, thus effecting an energized and latched condition of the relay 467 through the closed limit switch 420, while simultaneously applying an energizing signal to the high speed relay 476. Therefore, the first reversing motor 94 will become activated in its fast state, causing the conveyor chains 80 to advance the drive bar 92 therebetween across the top of the plate 65 at a relatively fast speed. Any stringer boards engaged thereby will be pushed from right to left in FIG. 6, at the same speed at which the drive bar 92 is advancing. The stringers (SI) will be advanced at the faster speed until the limit switch 420 is toggled, thus opening the latching signal to the relay 467.

As previously described, the limit switch 420 is initially toggled by means of the foremost outwardly directed cam surface 411 of the cam element 410 (see FIGS. 18, 19 and 20). In the preferred embodiment, the "foremost" cam element 410 is positioned along the conveyor chain 80*b* at a longitudinal position advanced slightly forward of the leading end of the advancing stringer boards between the stringer magazine base support guides 74. Since the length of the stringers to be employed is known in advance and is constant throughout the automated assembly process of any particular pallet configuration, the foremost cam element 410 can be accurately positioned along the conveyor chain 80*b* at the desired location. When the first outwardly directed cam surface 411 of the cam element 410 toggles the limit switch 420, the switching relay 467 will be de-energized, causing a simultaneous de-energization of the high speed solenoid 476 and an immediate reduction in speed (to its relatively slower speed) of the first reversing motor 94. Therefor, the advancing stringer boards (ST) are advanced at a relatively fast speed toward the nailing station until their leading edges just approach the nailing station, at which time the conveyor chains 80 are caused to advance at a much slower rate, by means of the toggling of limit switch 420.

The limit switch 424 is longitudinally spaced relative the first limit switch 420 at a predetermined distance, to allow sufficient time for the "slowing down process" of the conveyor chains 80 after the toggling of the limit switch 420, and such that its toggle arm 424(*t*) will be activated by the upper cam surface 414 of the advancing cam elements 410 at a point wherein the leading ends of the advancing stringers (ST) are approximately vertically aligned with the forward wall 120 (see FIG. 3) of the slat hopper. Upon toggling of the limit switch 424 by the upper cam surface 414 of the cam element 410, the slat board feed control circuit 440 (FIG. 21) is energized, as hereinafter described, causing the lowermost slat board within the slat hopper to be advanced onto the top surfaces of the underlying advancing stringers and at a speed relatively akin to that of the advancing stringers.

Referring to the slat feed control circuit 440 of FIG. 21, the "slat feed" enable switch 454 on the master control panel 446 when manually closed, enables the slat feed control circuit 440. In the initial start-up of the system, however, the slat feed enable switch 454 is closed only sequentially after the system start button 453 is momontarily closed to initiate a start-up of the control circuits. When the system start switch 453 is momentarily closed, an energizing signal is delivered thereby to the coil 460(*c*) of the switching relay 460. Upon energization, armatures 460(*a*1) and 460(*a*2) of the relay 460 are caused to engage the pair of upper contacts 460(*b*1) and 460(*b*2). The signal path provided by means of the first upper contact 460(*b*1) and the normally closed limit switch 424 provides an energizing latching signal to the coil 460(*c*) of the relay 460. This latching signal is maintained until the limit switch 424 is toggled to an open condition. Simultaneously, an energizing signal is applied by means of the first upper contact 460(b1) of the relay 460 and of the normally closed limit switch 428 to the "return" solenoid 470. Energization of the "return" solenoid 470 causes the slat feed motor 175 to become operable in its reversed direction, causing the slat board advancing plate 160 to be pulled in its rearmost (rightmost as viewed in FIG. 5) position by means of the rack and pinion gear assembly 163 and 164 respectively.

Note that as soon as the "system start" switch 453 is depressed, activating the relay 460, the "slat feed enable" switch 454 may be closed. When the slat board advancing plate 160 has reached its rearmost position, it will cooperatively engage and toggle the limit switch 428 to its open condition, de-energizing the "return" solenoid 470. The slat feed apparatus is now "ready" to provide a slat board (SL) to the advancing stringers (ST) of the system.

In its "ready" position, the coil 460(*c*) of the relay 460 remains energized, until the limit switch 424 is toggled to an open condition. When the upper cam surface 414 of the cam element 410 toggles the limit switch 424, the energizing signal to the coil 460(*c*) of the relay 460 is removed, thereby de-energizing the relay 460 and causing its armatures 460(*a*1) and 460(*a*2) to engage its lower pair of contacts 460(*d*1) and 460(*d*2). This de-energizing of relay 460 provides an energizing power signal via the closed "slat feed enable" switch 454 to the "slat feed" solenoid 471. When the solenoid 471 is energized, it provides a signal to the reversing valve 178 causing the slat feed motor 175 to become operable in its "forward" direction and the slat board advancing plate 160 to advance in its forward direction (from right to left as viewed in FIG. 5), and simultaneously energizes the pair of slat stop pistons 282 (FIG. 4). When energized, the slat stop pistons extend their stop elements 282 across the path of the slat board being advanced from the slat hopper.

As the slat advancing plate 160 moves in its forward direction, the limit switch 428 is reclosed (as illustrated in FIG. 21), and the forward edge (see FIG. 3) of the slat advancing plate 160 engages the lowermost slat board within the slat hopper and advances it through the forward slot defined by the lower edge of the wall 120 and the bottom plate 131 of the hopper and onto the top surfaces of the underlying advancing stringer boards. The speed of the slat feed motor 175 and the linkage assembly to the rack and pinion gears 115 and 116 respectively are cooperatively designed such that the speeds of the advancing plate 160 and that of the underlying stringer boards (ST) are relatively close.

When the slat advancing plate 160 has pushed a lowermost slat board from the slat hopper onto the advancing stringers such that the foremost edge of the slat board (SL) engages the extended stop elements 283, the lever arm 401 (see FIG. 14) will have simultaneously been pivoted in the clockwise direction about its pivot point 401(*p*) by means of the cam 402 so as to toggle the limit switch 400. When toggled, the movable contact 400(*a*) (FIG. 21) of the limit switch 400 will move from engagement with its first contact 400(*b*) to its second contact 400(*c*), thereby reapplying energizing power to the coil 460(*c*) of the relay 460. Accordingly, the return solenoid 470 will be re-energized, as previously discussed, to retract the slat advancing plate 160 to its rearmost position, thus recycling the slat feed system. Note that the limit switch 400 will maintain the energization of the relay 460 for the duration of the period of time in which the limit switch 400 remains toggled (i.e., whenever a slat board is in nailing position). Therefore, as long as a slat board is in position for nailing, the slat feeding apparatus will be disabled by means of the limit switch 400 from feeding another slat board to the nailing station. When the limit switch 400 is toggled, thus energizing the relay 460, the energizing signal to the slat feed solenoid 471 is removed, causing the pair of stop elements 283 of the stop pistons 282 to be retracted and allowing forward movement of the properly positioned slat board with the advancing stringers. The slat board (SL) is now in proper position for nailing to the underlying stringers at the nailing station.

Throughout the above described slat feeding and positioning process, the conveyor chains 80 have continually advanced (from right to left as viewed in FIG. 6), causing the first outwardly directed cam surface 411 of the foremost cam element 410 to activate the second limit switch 422. It should also be noted that due to the relative positioning of the toggle arms of the limit switches 422 and 424, the limit switch 424 remains in its activated position via the upper cam surface 414 throughout the toggling of the limit switch 422 by the first and second outwardly directed cam surfaces 411 and 412 and through the initial toggling of the limit switch 422 by the third outwardly directed cam surface 413. Toggling of the limit switch 422 activates the nailing circuit portion of the control apparatus.

Referring to FIG. 21, it will be noted that when the limit switch 400 within the slat feed circuit 440 has been toggled (indicating that a slat board is in proper position for nailing) the relay 460 is energized, closing the circuit established by its second armature 460(*a*2) and its second upper contact 460(*b*2) to the coil 461(*c*) of the first time delay relay 461. This circuit path to the coil 461(*c*) is the path which must be followed by a "nailing signal" to effect a nailing operation. It will be noted from FIG. 21, that following the proper positioning of a slat board transversely upon the advancing stringers, the conveyor chains continue to advance at a slow rate by reason of the energization of the "forward" solenoid 474 via the direction switch 450, the second armature and second lower contact 466(*a*2) and 446(*d*2) respectively of the switching relay 466 and the normally closed first movable contact 422(*a*1) of the limit switch 422. A nailing operation is effected each time one of the outwardly directed cam surfaces (411, 412 and 413) of the cam element 410 toggles the limit switch 422. Each toggling of the limit switch 422 effects a separate nailing operation as hereinafter described.

Prior to activation of the limit switch 422, the electrical status of the nail control circuits 422 is as follows: the switching relay 464 is energized via the normally closed second movable contact 422(*a*2) of the limit switch 422; the second time delay relay 463 and the switching relay 462 are de-energized since the plurality of limit switches 426 are normally open when the drive rods 200 of the automatic nailing units 190 are in their uppermost positions; the switching relay 465 is de-energized since the relay 464 is energized, causing its second armature 464(*a*2) to electrically contact its second upper contact 464(*b*2) which is electrically neutral; and, as previously described, the switching relay 460 is energized, thus enabling the first time delay relay 461 when the slat board is in proper position for nailing. When the limit switch 422 is toggled, its first movable contact 422(*a*1) opens the energizing circuit to the "forward" solenoid 474 by means of the relay 466, thus stopping the forward movement of the conveyor chains 80, arresting movement of the stringers and slat positioned thereon. Simultaneously, the second movable contact 422(*a*2) of the limit switch 422 removes one source of energization from the relay 464 while providing an energizing ("nailing signal") to the coil 461(*c*) of the first time delay relay 461 by means of the first armature and first lower contact 465(*a*) and 465(*d*1) respectively, the closed nailing enable switch 452 and the second armature and second upper contact 460(*a*2) and 460(*b*2) respectively of the relay 460. It will be noted, however, that the relay 464 remains energized by means of its latched condition through its first armature 464(*a*1) as long as the relays 462 and 465 remain de-energized.

Upon energization, the time delay relay 461 delays the transfer of the "nailing signal" to the first armature 462(*a*1) of the relay 462 by a predetermined time interval. The predetermined time interval by which the first time delay relay 461 delays the "nailing signal" is sufficient to enable the advancing stringers and attached slat board mounted thereon to come to rest at the nailing station and under the individual nailing positions of the automatic nailing units 190. When the predetermined time interval has lapsed, the first time delay relay 461 will switch, sending the nailing signal to the "down" solenoid 472 by means of the first armature and first lower contact 462(*a*1) and 462(*d*1) respectively of the relay 462. Upon receipt of the nailing signal, the "down" solenoid 472 will energize the plurality of ram cylinders 196 of the automatic nailing units 190, causing them to rapidly extend their drive rods 200 in the downard "nailing" direction, as hereinafter described. When the drive rods 200 of the nailing units 190 have effected a nailing operation and the nailing rams are in their lowermost positions, the cams 204 on the upper rods 203 of the nailing units 190 toggle the plurality of limit switches 426 to their closed positions, thus energizing the coil 462(*c*) of the second time delay relay 463. It will be noted that upon initiation of their downward movement, the cams 204 also open the plurality of limit switches 427.

Following a predetermined time delay, the second time delay relay 463 provides an energizing signal to the coil 462(*c*) of the switching relay 462, causing its armatures to electrically contact its upper contacts. Energization of the relay 462 breaks the latching energization signal to the relay 464, causing it to de-energize and to resume that electrical status illustrated in FIG. 21. Energization of the relay 462 further breaks the nailing signal to the "down" solenoid 472 and establishes an energizing signal to the "up" solenoid 473 by means of its first armature and first upper contact 462(*a*1) and 462(*b*1) respectively. Energization of the "up" solenoid 473 causes the ram cylinders 196 of the automatic nailing units 190 to be driven upward in preparation for a subsequent nailing operation, thus opening the plurality of limit switches 426. The second time delay relay 463 and the switching relay 462, however, remain energized due to the latching condition applied thereto via the second armature 462(*a*2) of the relay 462. Upon complete return of the ram cylinders 196 to their uppermost positions, the cam 204 on the upper rod 203 of the cylinders retoggles the plurality of limit switches 427. This provides an energizing signal from the power supply through the now closed limit switches 427 and the second armature and second lower contacts 464(*a*2) and 464(*d*2) respectively, of the switching relay 464 to energize the coil 465(*c*) of the switching relay 465. Upon energization, the switching relay 465 terminates the nailing signal by breaking the circuit path at its first armature 465(*a*1) and removes the energizing latching signal to the second time delay relay 463 via the switching relay 462, and provides an energizing signal to the switching relay 466 to resume the forward motion of the conveyor drive chains 80. The relay 465 acts as a "recycling" relay for enabling a subsequent nailing operation.

Upon recycling of the circuits via the relay 465, the conveyor chains 80 advance, removing the engagement of the outwardly directed cam surfaces with the toggling arm 422(*t*) of the limit switch 422, and reclosing the movable contacts 422(*a*1) and 422(*a*2) of the limit switch 422 in those positions illustrated in FIG. 21. Upon recycling, the energization states of the relays 462, 464 and 465 return to that condition previously described just prior to the nailing operation — and are once again positioned for initiating a subsequent nailing operation.

The nail control circuits 442 are thus repetitively enabled for sequentially effecting nailing operations as above described as long as the limit switch 400 remains toggled (indicating that a slat board remains ready for nailing at the nailing station). Therefore, the number of outwardly projecting cam surfaces (see 411, 412 and 413 in FIGS. 18 and 6) represent the actual number of nails to be driven into each slat board (SL) as they are intermittently advanced to the nailing positions of the automatic nailing units 190 where they momentarily stop while the nail is driven. The physical spacing between the outwardly directed cam surfaces, is directly analogous to the physical longitudinal spacing between sequentially driven nails through the slat boards and into the underlying stringers. Each of these parameters can be readily adjusted by respectively selecting cam elements 410 with the desired number of outwardly directed cam surfaces and by positioning these cam elements at properly spaced locations along the length of chain 80*b*. It will be noted that in the preferred embodiment all three of the automatic nailing units 190 are simultaneously operative, and that if any one of the automatic nailing units 190 should fail to operate properly, the appropriate limit switches 426 and 427 will indicate such a malfunction and disable the control system.

Following the nailing operation associated with the final (rearmost) outwardly directed cam surface 413 (FIG. 18) and the subsequent advancement of the stringers and secured slat board by means of recycling of the switching relay 465, the limit switch 400 resumes its position as illustrated in FIG. 21, indicating that a slat board is no longer available for nailing. Since the limit switch 424 is also now in an electrically open position, the relay 460 will be de-energized, "safing" any subsequent nailing operating and re-enabling subsequent feeding of a slat board to the advancing stringers for a subsequent nailing sequence.

The system automatically supplies slats to the advancing stringers and secures the slats to the stringers in stitch bond nailing fashion as above described as determined by the cam configuration and spacing along the conveyor chain 80*b*, i.e. the stringers longitudinally advance until cam activation momentarily stops them and initiates the driving of a nail through the slat, and the stringer then advances until a subsequent cam activation again stops the stringer advance and initiates the driving of another nail through the slat longitudinally spaced apart from the previously driven nail. When the trailing end of a group of advancing stringers pass beneath the nailing station and after the last slat is nailed thereto, the cam 415 (FIG. 6) appropriately longitudinally positioned along the inwardly directed side of the chain 80*b*, toggles the limit switch 425 to its closed position, (see FIG. 21) energizing the relay 467. Upon energization, the relay 467 is latched in its energized state by means of the energizing signal provided thereto through the limit switch 420. The "high speed" solenoid 476 is thereby energized, causing the conveyor chains 80 to advance at their rapid speed until the limit switch 420 it toggled by means of a cam element 410 indicating that another plurality of stringers is approximately approaching the nailing station as previously described. Thereafter, the automatic slat feeding and stitch nailing sequence is repeated.

Should any malfunctions occur during the operation of the automatic sequence of the machine, an operator of the machine can disable any portion of the circuitry by switching the appropriate switch upon the control panel 446. For example, should there be a malfunction in the nailing unit 190, the entire nailing operation can be disabled by the operator's opening of the nailing enable switch 452; should something jam within the conveyor system, the movement of the conveyor chains 80 can be reversed by switching the "direction" switch 450 so as to de-energize the "forward" solenoid 474 and to energize the "backward" solenoid 475.

A detailed operation of the mechanical operation of the automatic nailing units 190 can be understood with reference to FIGS. 9, 10, 11, 12, 13 and 15. Referring thereto, the nail track guides 270 provide a supply of nails to the nailing head assembly 205 such that one nail at a time is allowed to advance through the nail feed channel 222 downwardly into the guide cylinder 210 in resting engagement with the cooperating jaws 216 enclosing the lower terminous of the guide cylinder 210. When the automatic nailing units 190 receive an energizing signal from the "down" solenoid 472, the reversing valve 197 is appropriately opened so as to cause the piston within the ram cylinder 196 to rapidly advance in the "downward" direction, advancing the drive rod 200 longitudinally downward within the guide cylinder 210. The drive rod 200 (hammer) longitudinally advances within the guide cylinder 210 until its nailing hammer end 201 engages the head of that nail positioned against the jaws 216 at the bottom of the guide cylinder 210. The nail is driven by the drive hammer 200 downwardly between the cooperating jaws 216 which open against the bias of the spring elements 217 under the force of the downwardly advancing drive hammer 200. The vertical height of the head assembly 205 is adjusted before operation of the system such that the nailing hammer end 201 of the drive rod 200 advances downwardly through the open jaws 216 sufficiently far to drive the nail through the slat board and into the underlying stringer such that the head of the nail is slightly recessed within the slat board.

Prior to the downward descent of the drive rod 200, the nail gate member 244 is positioned in its leftmost (as viewed in FIG. 10) position as urged thereto by the cam surface 240 of the wall 235 of the actuator member 230. It will be noted that the actuator 230 is, under these conditions, positioned in its uppermost position (as illustrated in FIG. 12) with the enlarged shoulders 234*a* and 235*a* of its walls 234 and 235 respectively in engagement with the stopping surfaces 236*b*, as urged therein under bias of the coil springs 238. Referring to FIG. 10, when the nail gate element 244 is in its leftmost position, the path for advancement of nails on the nail track guide 270 to the nail feed channel 222 is obstructed by the gate element 244.

As the drive rod 200 advances downwardly within the guide cylinder 210, and nears the "bottom" of its stroke, its shoulder 202 (FIG. 4) engages the top plate 231 of the actuator 230, causing the actuator 230 to move downwardly therewith against the bias of the coil springs 238. As the actuator 230 moves in the downward direction as guided by the pair races 236, the gate element 244 (FIG. 12) is enabled to move from left to right along the cammed surface 240 of the wall member 235 of the actuator 230 under the bias of the spring 252. When the drive rod 200 is at the bottom of its nailing stroke, the gate element 244 will have moved to its rightmost position (see FIG. 10) such that its notch 249 is directly aligned with the central race defined by the nail track guide 270, thus allowing the shank of the foremost nail positioned between the track guides 270 to advance within the notch 249 of the gate element 244. The nails between the nail track guides 270 advance under gravity feed from the hopper 264 as aided by the vibration normally incident to the nailing operation and by the vibratory movement imparted to the tracks 270 from the oscillatory motion of the hopper 264.

When the drive rod 200 has completed its nailing stroke, it is upwardly returned within the guide cylinder 210 by energization of the "up" solenoid 473, causing its shoulder 202 to release its downward force upon the actuator 230, and enabling the actuator 230 to return to its uppermost position under the bias of the coil springs 238. As the actuator 230 returns to its uppermost position, the nail gate element 244 will be forced by means of the cammed surface 240 of the wall 235 of the actuator 230 to move from its rightmost to its leftmost position (as viewed in FIGS. 10 and 12) against the bias of the spring 252, causing the nail which had entered its notch 249 to be advanced along the slot 248 in the gate element 244 and into its aperture 247. As the nail reaches the aperture 247, its head will no longer be restrained by the gate element 244 and the nail will drop through the aperture 247, into the nail feed channel 222, proceeding downwardly into the guide cylinder 210 and into resting engagement with the cooperating jaws 216. The nailing head assembly is now "reloaded" for a subsequent nailing operation.

Referring to FIG. 9, the sensor switches 279 positioned along the pairs of nail guide tracks 270 sense the presence of a "full track" of nails and actuate the associated solenoid 278 at the outlet ports 268 of the nail hopper 264 to prevent more nails from entering the nail track guides 272, thus preventing clogging of the nail track guides 272.

While a specific embodiment of this invention has been disclosed, it is to be understood that this is for the purpose of illustration only, and that the invention is to be limited solely by the scope of the appended claims.

What is claimed is:

1. An automatic nailing apparatus for nailing transverse slats to spaced parallel stringers, said nailing apparatus comprising:

a. an elongated frame having a transversely extending frame member overlying said frame;

b. a plurality of stringer magazines for vertically stacking a plurality of stringers to extend longitudinally of said elongated frame at spaced parallel positions transversely thereof;

c. first conveyor and guiding means for advancing and simultaneously guiding a lowermost one of said vertically stacked stringers from each of said stringer magazines longitudinally of said elongated frame;

d. a slat magazine for vertically stacking a plurality of slats to extend transversely of the stringers between said transverse frame member and said plurality of stringer magazines;

e. second conveyor means for advancing and positioning a lowermost one of said vertically stacked slats onto said advancing stringers;

f. nailing means mounted on said transverse frame member and generally above said first conveyor means, for automatically nailing a slat to each of said advancing stringers, said nailing means including:

i. a plurality of nailing heads, each of said nailing heads having a hydraulically actuated hammer member for individually driving a nail into a slat positioned therebeneath;

ii. each of said nailing heads being transversely spaced apart from one another and in longitudinal alignment with one of said stringer magazines to drive a nail through a slat into an underlying stringer as it is positioned therebeneath; and iii. each of said nailing heads being maintained in a fixed longitudinal and lateral position during the automatic operation of that nailing apparatus; and g. control means:

i. for selectively advancing and momentarily stopping said first conveyor means to uniformly advance the lowermost ones of the stacked stringers to a position beneath said nailing heads where said first conveyor means may be momentarily stopped with a slat positioned beneath each said nailing head while a nail is driven by the hammer elements;

ii. for periodically actuating said second conveyor means, responsive to positional advancement of said first conveyor means, to advance and position said lowermost stacked slat onto said advancing stringers and subsequently to a position beneath said nailing heads; and iii. for actuating said nailing means in cooperation with the momentary stopping of said first conveyor means, to simultaneously energize each of said nailing heads at least one time, thereby driving a nail through the slats into each of the underlying stringers, and to then allow said first conveyor means to advance.

2. An automatic nailing apparatus according to claim 1, wherein said elongated frame includes generally planar surface portions for supporting said longitudinally advancing stringers and wherein said means for guiding said advancing stringers comprises: a plurality of pairs of elongated stringer guide members, one each of said pairs operatively cooperable with one of said stringer magazines and extending longitudinally therefrom at a receiving end of said frame to at least the position of said nailing heads, and mounting means for securing said plurality of stringer guide members to said elongated frame in overlying relationship with said supporting surface portions, such that the stringer guide members of each of said pairs define a race therebetween for permitting unobstructed longitudinal movement of said advancing stringers therealong in a direction toward the position of said nailing heads.

3. An automatic nailing apparatus according to claim 2, wherein said first conveyor means comprises:

a. a pair of transversely spaced endless linked chains, b. sprocket means for mounting one each of said spaced chains adajcent the opposing longitudinal edges of said elongated frame with an upper flight of each chain positioned above said planar surface portions and connected for common movement longitudinally of said elongated frame;

c. at least one connecting drive element extending between and connected to said pair of chains to simultaneously engage the lowermost ones of the vertically stacked stringers from each of the plurality of stringer magazines and to longitudinally advance said engaged stringers along said races defined by the associated pairs of stringer guide members toward said nailing station; and d. power means for simultaneously driving said pair of chains to advance said upper flights to the chains longitudinally of said elongated frame from said receiving end toward said nailing heads.

4. An automatic nailing apparatus according to claim 3, wherein said mounting means includes transversely extending support members secured to said elongated frame for supporting the longitudinal ends of said stringer guide members in spaced relationship above said underlying planar surface portions such that said connecting drive element is free to pass between said stringer guide members and the underlying planar surface portions, and wherein said mounting means is adjustably configured to enable lateral positioning of individual stringer guide members relative one another and to enable lateral adjustment of the respective pairs of said stringer guide members relative other pairs of said guide members.

5. An automatic nailing apparatus according to claim 4, wherein a correpsonding one of each pair of said stringer guide members includes means adjacent said nailing heads for yieldingly urging a stringer positioned within said race defined by that pair of stringer guide members toward the oppositely disposed guide member of that pair.

6. An automatic nailing apparatus according to claim 4, wherein each of said plurality of stringer magazines comprises:

a. a pair of spaced side wall portions each fixedly mounted on and extending upwardly from and longitudinally of an associated one of said pair of stringer guide members, said sidewall portions each having oppositely disposed end edges and an upper edge; and b. a transverse stop wall member mounted to at least one of said side wall portions and adjacent that one of said end edges thereof proximate said slat magazine, the opposite ones of said end edges of the spaced side walls cooperatively laterally defining an open end to the magazine proximate said receiving end of the system, and said upper edges of the spaced side wall portions cooperatively flaring outwardly to define an upwardly opening mouth to the magazine.

7. An automatic nailing apparatus according to claim 1, wherein said nailing means includes a nailing head at each nailing position, and nail supply means for continuously supplying nails to each of said nailing heads, each of said nailing heads comprising:

a. a gate means cooperatively connected with said nail supply means for controlling the entrance of nails to that nailing head; and b. a hammer means including said hammer member and operatively connected to and activated by said control means for engaging a nail within said nailing head and for driving said engaged nail out of said nailing head.

8. An automatic nailing apparatus according to claim 7, wherein said control means includes means operatively connected to each of said plurality of hammer means for simultaneously activating said hammer means.

9. An automatic nailing apparatus according to claim 7, wherein each of said nailing heads comprises:

a. a housing defining a vertically extending first passageway having an upper end and a lower end, said lower end of said first passageway terminating in close proximity to said positioned slat and defining said nailing position for that nailing head assembly;

b. a second passageway formed in said housing having an upper end and a lower end, said lower end of the second passageway communicating with said first passageway between its said upper and lower ends;

c. cooperating spring biased jaw elements connected to normally yieldingly close the lower end of said first passageway; and d. wherein said gate means is positioned adjacent said upper end of said second passageway for cooperative engagement by said hammer means during its nailing motion.

10. An automatic nailing apparatus according to claim 9, wherein said nail supply means includes a plurality of pairs of nail guide tracks for holding a plurality of nails in consecutive alignment therebetween, one each of said nail guide track pairs mounted for opening into said upper end of said second passageway of each of the nailing head assemblies, and wherein each of said gate means comprises:

a. a plate-like gate member mounted on said nailing head apparatus adjacent said upper end of said second passageway for reciprocal movement between a first position blocking entrance of nails from said nail guide track to said second passageway associated therewith, and a second position causing delivery of a single nail from said associated nail guide track to said second passageway;

b. actuator means movably mounted to said nailing head and engageable by said hammer means, for enagaging and causing movement of said gate member to its said first position and for limiting movement of said gate member to its said second position in response to engagement and disengagement respectively of said actuator means by said hammer means;

c. first spring means operatively connected with said gate member for normally urging said gate member toward rest in its said second position; and d. second spring means operatively connected with said actuator means for normally urging said actuator means toward engagement with said gate member so as to urge said gate member toward rest in its said first position against the bias of said first spring means, said second spring means having a greater spring force than first spring means.

11. An automatic nailing apparatus according to claim 10, wherein each of said plate members is characterized by:

a. an edge portion disposed adjacent that said nail guide track mounted to supply nails to said associated second passageway of the nailing head assembly, a portion of said edge defining a blocking surface for blocking the exit of nails from said nail guide track when said plate member is positioned in its said first position;

b. a notch formed in said edge portion and disposed adjacent said blocking surface so as to be offset from said nail guide track when said plate member is positioned in its said first position, and so as to be aligned with said nail guide track when said plate member is positioned in its said second position;

c. an aperture formed through said plate member and disposed therealong so as to be vertically aligned with said upper end of said second passageway when said plate member is positioned in its said first position;

d. a slot formed through said plate member extending between and connecting said notch with said aperature for allowing passage of a nail shank therebetween; and e. a gate cam surface forming a longitudinally disposed end of said plate member;

and wherein said actuator means is mounted for reciprocatory movement parallel to the longitudinal axis of said first passageway of the nailing head assembly and defines an actuator cam surface positioned to cooperatively engage said gate cam surface for imparting movement to said gate member between its said first and second positions respectively in response to engagement and disengagement of said actuator means by said hammer means.

12. An automatic nailing apparatus according to claim 11, wherein said hammer means includes siad hammer member being vertically movable within said first passageway of the nailing head assembly in response to said control means, said hammer member having abutment means thereon for engaging and moving said actuator means against bias of said second spring means in response to movement of said hammer member toward engagement with said positioned nail within said first passageway.

13. An automatic nailing apparatus according to claim 9, wherein said nailing means includes a plurality of mounting plates for mounting each of said nailing heads to said transverse frame member, said mounting plates including adjustment means for laterally adjustably positioning said respective nailing heads transversely of said elongated frame, and wherein each of said hammer means includes a hydraulically operated ram mounted to said mounting plate and having a nailing hammer piston rod axially aligned with and operatively extendable through said first passageway of said associated nailing head assembly.

14. An automatic nailing apparatus according to claim 13, wherein said nail supply means includes:

a. a nail hopper; and b. a plurality of nail guide tracks one each of said tracks extending from said nail hopper to one of said nailing heads and communicating with said nail gate means thereof; wherein said nail hopper and guide tracks are cooperatively constructed to continuously deliver nails to said nail gate means in a head-up orientation.

15. An automatic nailing apparatus according to claim 14, including a sensor positioned on each of said nail guide tracks operative to signal the presence of the predetermined number of nails in that respective nail guide track, and a plurality of barrier members, one each of said barrier members being operatively connected with one of said sensors and positioned at the juncture of each of said nail guide tracks with said nail hopper to selectively prevent the entrance of nails into that nail guide track in response to said signal from its associated sensor.

16. An automatic nailing apparatus according to claim 1, wherein said second conveyor means includes:

a. a pair of stop members mounted on said transverse frame member at longitudinally spaced positions therealong and operatively movable between first and second positions, said stop members being operative in their said first positions to obstruct the path of travel of a slat board positioned upon said advancing stringers, and operable in their said second positions to permit unobstructed travel of a slat board positioned upon said advancing stringers, said pair of stop members when positioned in their said first positions being operative to align an engaged advancing slat board relative the underlying stringers;

b. means operatively connected with said pair of stop members for imparting said movement thereto between said first and second positions; and c. wherein said control means includes means operatively connected to said stop member movement means for causing said stop members to become positioned in their said first positions immediately prior to the nailing of said slat to the underlying stringers and to become positioned in their said second positions during the nailing of said slat to the stringers.

17. An automatic nailing apparatus according to claim 1, wherein said slat magazine includes an upwardly opening receptacle having a front side wall mounted on said transverse frame member, a rear side wall spaced from said front side wall, opposed spaced end walls and a bottom wall, said front and rear side walls terminating spaced from said bottom wall to define a front and a rear slot adjacent said bottom wall; and wherein said second conveyor includes:

a. a slat board advancing plate operatively mounted for longitudinal movement through said rear slot to engage a lowermost slat in said slat magazine and to longitudinally advance the engaged slat through said front slot onto said underlying advancing stringers at the position of said nailing heads;

b. a gear rack longitudinally fixedly mounted on each opposite end of said advancing plate;

c. a pinion gear cooperatively mounted in meshing engagement with each of said gear racks;

d. a rotary pinion shaft rotatably mounted on said rear side wall and connecting said pinion gears for common rotation; and e. power means connected to impart rotation to said pinion gears in opposite first and second rotational directions for respectively longitudinally advancing and retracting said advancing plate.

18. An automatic nailing apparatus according to claim 17, wherein said power means comprises a hydraulically driven motor having a rotary output shaft operatively connected to said rotary pinion shaft by an endless link chain entrained over a drive and a driven sprocket respectively fixedly mounted on said rotary output shaft and on said pinion shaft.

19. An automatic nailing apparatus according to claim 17, wherein the lower edges of said opposed end walls terminate adjacent an upper surface of said advancing plate, wherein said opposed end walls are each mounted for adjustable movement toward and away from each other, wherein said front and rear side walls are spaced apart a distance predetermined to be greater than the transverse dimension of slats contained within said receptacle and wherein said apparatus includes spaced arms mounted on said rear side wall and projecting between said rear and front side walls operatively movable toward and away from said front side wall to engage and urge the lower slats in said receptacle toward engagement with said front side wall.

20. An automatic nailing apparatus according to claim 19, wherein said spaced arms each have an upper end and a lower end, wherein each spaced arm is pivotally connected near its said upper end to said rear side wall and wherein said lower ends of the spaced arms are movable toward and away from said front side wall, and including means connected between said rear side wall and said lower end of each of said spaced arms for imparting said pivotal movement to said lower end.

21. An automatic nailing apparatus according to claim 20, wherein said means for imparting movement to said lower ends of said spaced arms, comprises:

a. a crank shaft having a pair of corresponding crank arms and a third crank arm;

b. means for rotatably mounting said crank shaft on said rear side wall;

c. a link pivotally connected to each of said corresponding crank arms and to said pair of spaced arms; and d. a hydraulic ram pivotally operatively connected between said third crank arm and said rear wall.

22. An automatic nailing apparatus according to claim 1, wherein said first conveyor means includes a pair of endless link chains transversely spaced of said elongated frame, at least one of said link chains having individual links connected by cylindrical tubular connectors of the type having axial openings oriented so as to project transversely of the longitudinal length of the chain; and wherein said control means includes:

a. a plurality of cam members detachably secured to said one endless link chain at spaced positions therealong, each cam member having a plurality of cam surfaces formed thereon;

b. a plurality of switch members mounted on said elongated frame and positioned for activation by said cam surfaces of said cam members secured to said one endless link chain in response to movement of said one endless link chain longitudinally of the elongated frame member; and c. circuit means operatively connected to receive activation signals from said switch members for sequentially cooperatively actuating said first and second conveyor means and said nailing means.

23. An automatic nailing apparatus according to claim 20, wherein said cam members each comprise:

a. a U-shaped mounting bracket having generally parallel extendable leg portions, sized to be telescopically received in selected ones of said axial openings in said tubular connectors of said one link chain;

b. a main cam body member configured to define said plurality of cammed surfaces; and c. mounting means for adjustably mounting said main cam body member on said U-shaped mounting bracket in a manner enabling adjustment of the main cam body member longitudinally relative said one endless link chain.

24. An automatic nailing apparatus according to claim 23, wherein the maximum longitudinal adjustment distance permitted by said means mounting said main cam body to said U-shaped mounting bracket is at least equal to the distance between adjacent ones of said axial openings of said tubular connectors in said one endless link chain.

25. An automatic nailing apparatus according to claim 22, wherein said control means further includes at least one pair of switches mounted on said transverse frame member adjacent one of said hammer means, wherein one of said pair of switches is operatively engaged by said hammer means to indicate a down nailing position and the other of said pair of switches is operatively engaged by said hammer means to indicate a normally up position, wherein a third switch is mounted on said transverse frame member and is operative to indicate the presence of a slat at the position of said nailing heads and wherein electrical circuit means is provided for operably connecting said plurality of switch members said pair of switches and said third switch to actuate said first conveyor means said second conveyor means and said nailing means in a predetermined sequence to nail a slat to said stringers at each of said nailing heads.

* * * * *

UNITED STATES PATENT OFFICE

CERTIFICATE OF CORRECTION

PATENT NO. : 3,945,549

DATED : March 23, 1976

INVENTOR(S) : Donald W. Colson

It is certified that error appears in the above-identified patent and that said Letters Patent are hereby corrected as shown below:

In column 5, line 12, after "inner" delete "wall".

In column 5, line 37, "end" should read --ends--.

In column 5, line 50, "th" should read --the--.

In column 7, line 25, "repectively" should read --respectively--.

In column 7, line 26, "spockets" should read --sprockets--.

In column 8, line 52, the words "is effects" should read --is effected--.

In column 14, line 14, "Figs. 1 to 9," should read --Figs. 1 and 9,--.

In column 14, line 36, "high" should read --higher--.

In column 15, line 47, "190aa 190c" should read --190a and 190c.--.

In column 16, line 28, "attachably" should read --attachable--.

In column 17, line 33, "at" should read --as--.

In column 19, line 45, "427(e)" should read --427A(e)--.

In column 19, line 51, "427(e)" should read --427C(e)--.

In column 21, line 62, "one" should read --ones--.

In column 22, line 31, "become" should read --adequate--.

In column 22, line 44, "82" should read --92--.

UNITED STATES PATENT OFFICE

CERTIFICATE OF CORRECTION

PATENT NO. : 3,945,549

DATED : March 23, 1976

INVENTOR(S) : Donald W. Colson

It is certified that error appears in the above-identified patent and that said Letters Patent are hereby corrected as shown below:

In column 24, line 38, "467(bl)" should read --467(al)--.

In column 24, line 49, "(SI)" should read --(ST)--.

In column 26, line 14, "282" should read --283--.

In column 27, line 31, "422" should read --442--.

In column 30, line 60, "pair races" should read --pair of races--.

In column 33, line 2, delete "station" and insert --heads--.

In column 33, line 4 after "flights" delete "to" and insert --of--.

In column 33, line 22, "correpsonding" should read --corresponding--.

In column 34, line 34, "enagaging" should read --engaging--.

In column 35, line 19, "siad" should read --said--.

Signed and Sealed this

Tenth Day of August 1976

[SEAL]

*Attest:*

RUTH C. MASON
*Attesting Officer*

C. MARSHALL DANN
*Commissioner of Patents and Trademarks*